US012044463B2

(12) United States Patent
Jia et al.

(10) Patent No.: US 12,044,463 B2
(45) Date of Patent: Jul. 23, 2024

(54) REFRIGERATOR

(71) Applicant: Hisense (Shandong) Refrigerator Co., Ltd., Qingdao (CN)

(72) Inventors: Zhenfei Jia, Qingdao (CN); Weilun Zhang, Qingdao (CN); Xiangping Zhang, Qingdao (CN); Dong Guo, Qingdao (CN)

(73) Assignee: HISENSE (SHANDONG) REFRIGERATOR CO., LTD., Qingdao (CN)

( * ) Notice: Subject to any disclaimer, the term of this patent is extended or adjusted under 35 U.S.C. 154(b) by 0 days.

(21) Appl. No.: 17/761,129

(22) PCT Filed: Jan. 11, 2022

(86) PCT No.: PCT/CN2022/071408
§ 371 (c)(1),
(2) Date: Mar. 16, 2022

(87) PCT Pub. No.: WO2023/024409
PCT Pub. Date: Mar. 2, 2023

(65) Prior Publication Data

US 2024/0053086 A1 Feb. 15, 2024

(30) Foreign Application Priority Data

Aug. 24, 2021 (CN) ..... 202110974363.5
Sep. 15, 2021 (WO) ..... PCT/CN2021/118611
Sep. 17, 2021 (CN) ..... 202122263810.4

(51) Int. Cl.
*F25D 23/02* (2006.01)

(52) U.S. Cl.
CPC ..... *F25D 23/028* (2013.01)

(58) Field of Classification Search
CPC ..... F25D 23/028; F25D 2323/021
(Continued)

(56) References Cited

U.S. PATENT DOCUMENTS 9,163,870 B2 * 10/2015 Jeon ..... F25D 23/02
9,845,628 B2 * 12/2017 Jung ..... E05F 1/10
(Continued)

FOREIGN PATENT DOCUMENTS

CN 101416011 A 4/2009
CN 102506547 A 6/2012
(Continued)

OTHER PUBLICATIONS

Office Action issued in corresponding Chinese Patent Application No. 202110974363.5 dated Oct. 28, 2022 with English Translation.
(Continued)

*Primary Examiner* — Janet M Wilkens
*Assistant Examiner* — Timothy M Ayres
(74) *Attorney, Agent, or Firm* — Morgan, Lewis & Bockius LLP

(57) ABSTRACT

A refrigerator is provided, which includes a refrigerator body, a pair of door bodies, a turnover beam, a guide seat and a limiting block. The turnover beam is pivotally connected with one of the pair of door bodies, and the turnover beam includes a turnover beam body. The guide seat includes a guide seat body and a guide groove disposed in the guide seat body. The limiting block is rotatably connected with the guide seat body. When at least a portion of the guide block presses the limiting block through the front side opening of the guide groove, the limiting block is configured to pivot and exit the guide groove, and after the guide block enters the guide groove, the limiting block is configured to be reset by pivoting to limit the guide block.

14 Claims, 21 Drawing Sheets

(58) Field of Classification Search
USPC ..... 312/405
See application file for complete search history.

(56) References Cited

U.S. PATENT DOCUMENTS

| | | | | |
|---|---|---|---|---|
| 9,874,391 | B2 * | 1/2018 | Jung | F25D 23/025 |
| 10,429,121 | B2 * | 10/2019 | Yoon | F25D 21/04 |
| 10,775,095 | B2 * | 9/2020 | Gwon | F25D 25/025 |
| 2009/0113927 | A1 | 5/2009 | Laible | |
| 2012/0137722 | A1 | 6/2012 | Kim | |
| 2023/0235945 | A1 * | 7/2023 | Kang | F25D 21/04 312/405 |

FOREIGN PATENT DOCUMENTS

| | | | | | |
|---|---|---|---|---|---|
| CN | 103292540 | A | | 9/2013 | |
| CN | 103307840 | A | * | 9/2013 | F25D 23/028 |
| CN | 103307840 | A | | 9/2013 | |
| CN | 104344652 | A | | 2/2015 | |
| CN | 104457120 | A | | 3/2015 | |
| CN | 106595201 | A | | 4/2017 | |
| CN | 206113490 | U | | 4/2017 | |
| CN | 206235072 | U | | 6/2017 | |
| CN | 206593371 | U | | 10/2017 | |
| CN | 107461992 | A | | 12/2017 | |
| CN | 109442856 | A | | 3/2019 | |
| CN | 215337279 | U | | 12/2021 | |
| JP | 2002-62031 | A | | 2/2002 | |
| JP | 2004-353943 | A | | 12/2004 | |
| JP | 2007-064600 | A | | 3/2007 | |
| KR | 10-2011-0032898 | A | | 3/2011 | |

OTHER PUBLICATIONS

International Search Report and Written Opinion issued in corresponding International Application No. PCT/CN2021/118611 dated Apr. 26, 2022, with English translation.

International Search Report and Written Opinion issued in corresponding International Application No. PCT/CN2022/071408 dated May 20, 2022, with English translation.

* cited by examiner

REFRIGERATOR

CROSS-REFERENCE TO RELATED APPLICATIONS

This disclosure is a national phase entry under 35 USC 371 of International Patent Application No. PCT/CN2022/071408, filed on Jan. 11, 2022, which claims priorities to Chinese Patent Application No. 202110974363.5, filed on Aug. 24, 2021, Chinese Patent Application No. 202122263810.4, filed on Sep. 17, 2021, and PCT International Patent Application No. PCT/CN2021/118611, filed on Sep. 15, 2021, which claims the priority to the Chinese Patent Application No. 202110974363.5, filed on Aug. 24, 2021, which are incorporated herein by reference in their entities.

TECHNICAL FIELD

The present disclosure relates to the technical field of household appliances, and in particular, to a refrigerator.

BACKGROUND

In a side-by-side refrigerator, in order to improve a sealing effect of the refrigerator, a turnover beam is generally disposed on a sidewall of either of a pair of door bodies of the refrigerator. The turnover beam may be construed as a vertical beam capable of pivoting around a vertical axis by 90 degrees (i.e., 90°), and the turnover beam is sealingly engaged with the pair of door bodies of the refrigerator, so that a relatively confined space is formed between a refrigerator body and the door bodies to achieve preservation of cold air.

SUMMARY

A refrigerator is provided, which includes a refrigerator body, a pair of door bodies, a turnover beam, a guide seat, and a limiting block. The refrigerator body includes a storage compartment. The pair of door bodies are pivotally connected with the refrigerator body to open or close the storage compartment. The turnover beam is pivotally connected with one of the pair of door bodies to seal a gap between the pair of door bodies when closing the storage compartment, and the turnover beam includes a turnover beam body and a guide block located on a top of the turnover beam body. The guide seat is located on a top of the storage compartment, the guide seat includes a guide seat body and a guide groove disposed in the guide seat body, and the guide groove is open at a bottom thereof and includes a front side opening, so that the guide groove is engaged with the guide block. The limiting block is rotatably connected with the guide seat body. When at least a portion of the guide block presses the limiting block through the front side opening of the guide groove, the limiting block is configured to pivot and exit the guide groove, and after the guide block enters the guide groove, the limiting block is configured to be reset by pivoting to limit the guide block.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on actual sizes of products, actual processes of methods and actual timings of signals to which the embodiments of the present disclosure relate.

FIG. 9B is upside down;

DETAILED DESCRIPTION

Figure 1:
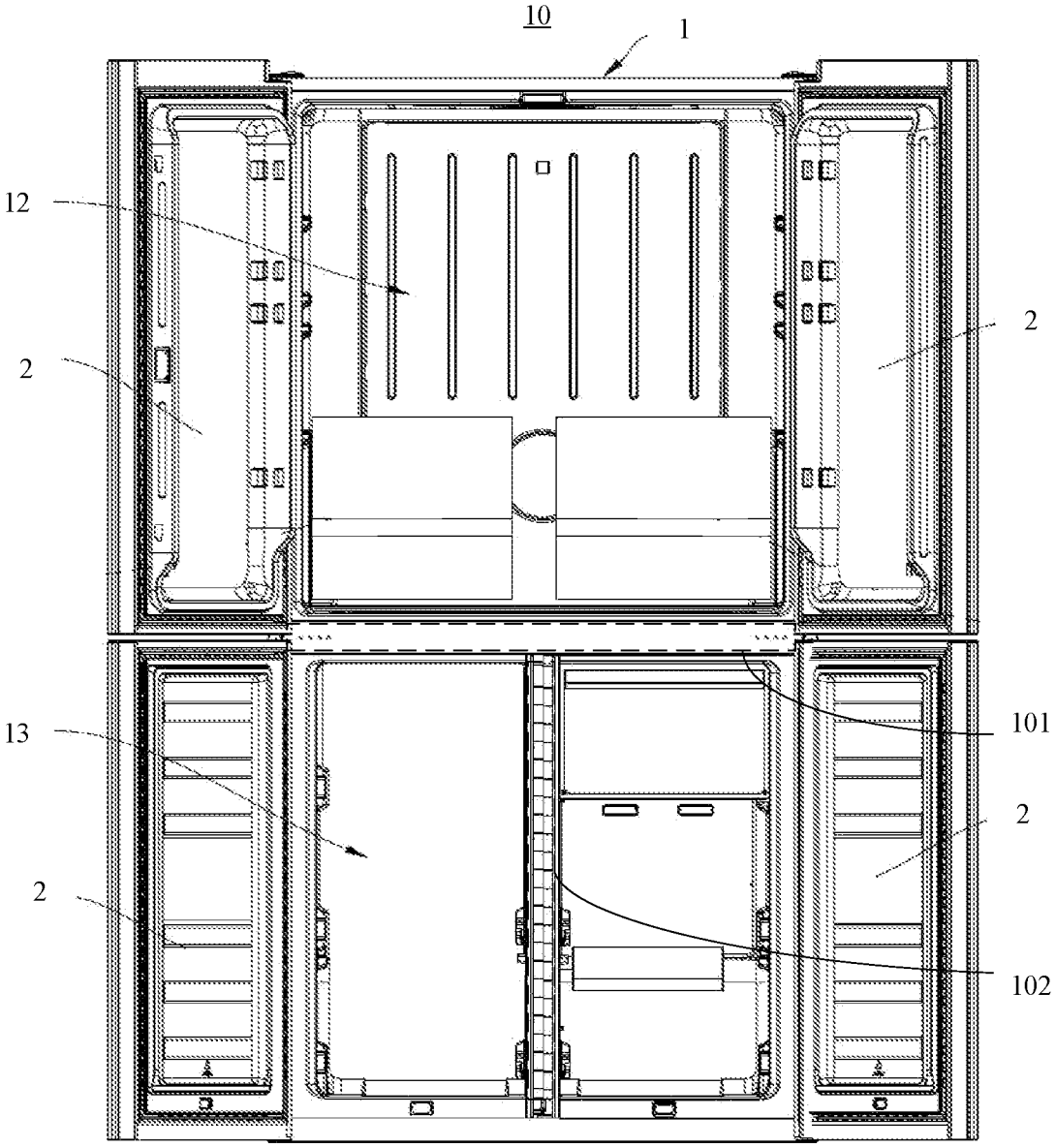
FIG. 1 is a diagram showing a structure of a refrigerator with door bodies in an open state, in accordance with some embodiments.

Technical solutions in some embodiments of the present disclosure will be described clearly and completely below with reference to the accompanying drawings. However, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, the terms such as "one embodiment". "some embodiments", "exemplary embodiments", "example", "specific example" or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, features defined with "first" and "second" may explicitly or implicitly include one or more of the features. In the description of the embodiments of the present disclosure, "a/the plurality of" means two or more unless otherwise specified.

In the description of some embodiments, the terms "coupled" and "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B and C" has a same meaning as the phrase "at least one of A, B or C", and they both include the following combinations of A, B and C: only A, only B, only C, a combination of A and B, a combination of A and C, a combination of B and C, and a combination of A, B and C.

The phrase "A and/or B" includes the following three combinations: only A, only B. and a combination of A and B.

As used herein, the term "if", depending on the context, is optionally construed as "when" or "in a case where" or "in response to determining" or "in response to detecting". Similarly, the phrase "if it is determined" or "if [a stated condition or event] is detected", depending on the context, is optionally construed as "in a case where it is determined" or "in response to determining" or "in a case where [the stated condition or event] is detected" or "in response to detecting [the stated condition or event]".

The use of the phrase "applicable to" or "configured to" herein means an open and inclusive expression, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values exceeding those stated.

The term "about", "substantially" or "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

The term such as "parallel", "perpendicular" or "equal" as used herein includes a stated condition and a condition similar to the stated condition. A range of the similar condition is within an acceptable range of deviation. The acceptable range of deviation is determined by a person of ordinary skill in the art, considering measurement in question and errors associated with measurement of a particular quantity (i.e., limitations of a measurement system). For example, the term "parallel" includes absolute parallelism and approximate parallelism, and an acceptable range of deviation of the approximate parallelism may be, for example, a deviation within 5°; the term "perpendicular" includes absolute perpendicularity and approximate perpendicularity, and an acceptable range of deviation of the approximate perpendicularity may also be, for example, a deviation within 5°. The term "equal" includes absolute equality and approximate equality, and an acceptable range of deviation of the approximate equality may be, for example, a difference between two equals of less than or equal to 5% of either of the two equals.

A side of a refrigerator 10 facing a user during use is defined as a front side, and a side opposite to the front side is defined as a rear side.

Figure 2:
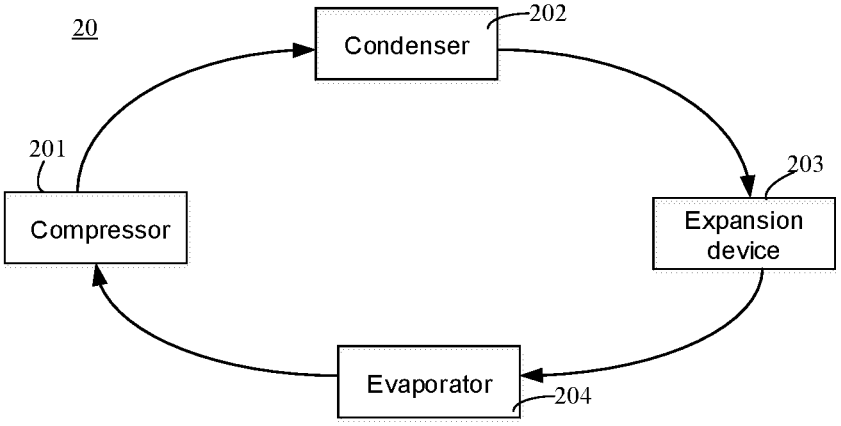
FIG. 2 is a schematic diagram of a cold air supply device of a refrigerator, in accordance with some embodiments.

In some embodiments, referring to FIGS. 1 and 2, the refrigerator 10 includes a refrigerator body 1, a cold air supply device 20 and a door body 2. The refrigerator body 1 includes a storage compartment, the cold air supply device 20 is configured to cool the storage compartment, and the door body 2 is configured to open and close the storage compartment.

The cold air supply device 20 cools the storage compartment by performing heat exchange with an outside of the refrigerator body 1. As shown in FIG. 2, the cold air supply device 20 includes a compressor 201, a condenser 202, an expansion device 203 and an evaporator 204, and a refrigerant circulates in a sequence of the compressor 201, the condenser 202, the expansion device 203, the evaporator 204 and the compressor 201 to cool the storage compartment.

For example, the evaporator 204 may be arranged to be in contact with an outer wall of the storage compartment to directly cool the storage compartment. In some embodiments, the cold air supply device 20 may further include a circulation fan to circulate air in the storage compartment through the evaporator 204 and the circulation fan.

Figure 3A:
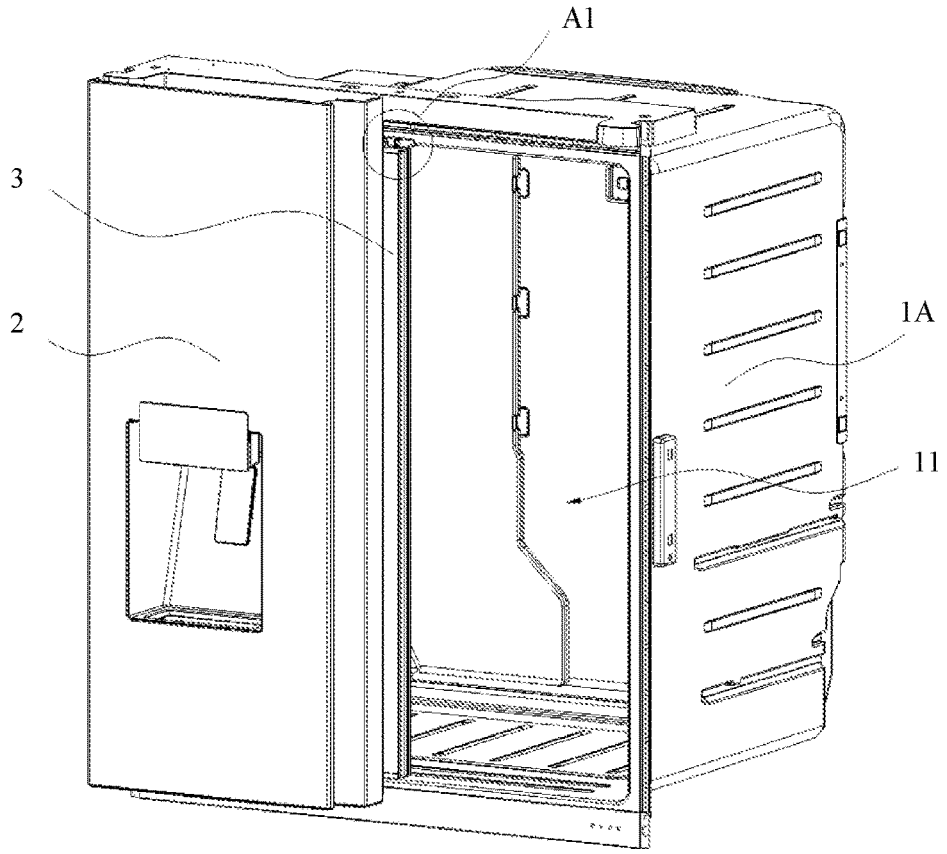
FIG. 3A is a diagram showing a local structure of a refrigerator, in accordance with some embodiments.

In some embodiments, the refrigerator body 1 may adopt a hollow rectangular parallelepiped structure. The refrigerator body 1 may include a plurality of storage compartments, such as a refrigerating compartment, a freezing compartment, and a variable temperature compartment, so as to meet different refrigeration requirements such as refrigerating, freezing, and temperature changing according to different types of food. As shown in FIG. 3A, the refrigerator body 1 includes a refrigerator liner 1A, and a storage compartment 11 is defined in the refrigerator liner 1A. It will be understood that the refrigerator body 1 may include a plurality of refrigerator liners 1A, and each refrigerator liner 1A may define a storage compartment 11, or each refrigerator liner 1A may define a plurality of storage compartments 11.

The plurality of storage compartments 11 may be spaced apart in a height direction of the refrigerator body 1, or the plurality of storage compartments 11 may be spaced apart in a width direction of the refrigerator body 1.

In some embodiments, the refrigerator body 1 includes a first partition 101 disposed at a middle position of the refrigerator body 1 in the height direction, and the height direction of the refrigerator body 1 refers to an up-and-down direction in FIG. 1. The first partition 101 extends in a left-and-right direction in FIG. 1, and a substantial position of the first partition 101 is as shown by the dashed box in FIG. 1. The storage compartment is partitioned into an upper storage compartment 12 and a lower storage compartment 13 by the first partition 101. In some embodiments, the upper storage compartment 12 is used as a refrigerating compartment for storing food in a refrigerating mode, the refrigerator body 1 may further include a second partition 102 disposed perpendicular to the first partition 101, and the second partition 102 may partition the lower storage compartment 13 into the freezing compartment and the variable temperature compartment.

The door body 2 is pivotally connected with the refrigerator body 1, so as to open or close the storage compartment. For example, the door body 2 may be hinged to a front end of the refrigerator body 1. Four door bodies 2 are shown in FIG. 1. The four door bodies 2 include a refrigerating compartment door, a freezing compartment door, and a variable temperature compartment door. The refrigerating compartment door is configured to open or close the refrigerating compartment, the freezing compartment door is configured to open or close the freezing compartment, and the variable temperature compartment door is configured to open or close the variable temperature compartment.

With a continuous upgrading of consumption, a capacity of the refrigerator 10 continues to increase, and at least one of the refrigerating compartment, the freezing compartment, or the variable temperature compartment is provided with two door bodies 2. For ease of description, some embodiments of the present disclosure are mainly described by taking an example in which the refrigerating compartment is provided with two door bodies 2. However, this should not be construed as a limitation on the present disclosure.

In some embodiments, the refrigerator 10 generally includes two refrigerating compartment doors. In order to ensure airtightness between the two side-by-side refrigerating compartment doors when they are closed, and further to prevent convection of air inside and outside the storage compartment 11 (e.g., the refrigerating compartment) and enhance a heat preservation effect, the refrigerator 10 further includes a turnover beam 3. The turnover beam 3 is located on either of the two refrigerating compartment doors; for example, the turnover beam 3 is located in a middle of the two refrigerating compartment doors.

In some embodiments, in a process of closing the refrigerating compartment doors, the user is required to correctly operate the turnover beam 3 to close the door body 2. When the door body 2 is closed, if an angle of the turnover beam 3 is incorrect due to a rotation of the turnover beam 3 with the door body 2, the turnover beam 3 and the door body 2 will easily collide, resulting in damages to the turnover beam 3 and the door body 2.

As shown in FIGS. 4A to 4D, the door body 2 includes a door liner 21 and a door seal 22, which are located on a side (e.g., a rear side) of the door body 2 proximate to the refrigerator body 1, and the door seal 22 is attached to an edge of the door liner 21. The door liner 21 includes a door seal groove located on the edge of the door liner 21. In some embodiments, the door seal groove is configured as a rectangular annular groove disposed around the door liner 21. The door seal 22 is installed in the door seal groove, and the door seal 22 is configured to be attached to an edge of a side (e.g., a front side) of the refrigerator liner 1A proximate to the door body 2 in a case where the door body 2 is in a closed state, so as to seal a gap between the door body 2 and the refrigerator body 1, thereby blocking heat exchange inside and outside the storage compartment 11 and reducing energy consumption of the refrigerator 10. Since the door seal groove is blocked by the door seal 22, the door seal groove is invisible in FIGS. 4A and 4C.

The turnover beam 3 is generally disposed on a sidewall of either of the two side-by-side door bodies 2 of the refrigerator 10. As shown in FIGS. 3A to 3D, the door body 2 on a right side (i.e., a right side for the refrigerator 10 and a left side for an observer) of the two door bodies 2 is provided with the turnover beam 3 on the sidewall thereof, and the turnover beam 3 is pivotally connected with the door body 2 on the right side (e.g., the refrigerating compartment door on the right side). Therefore, in a case where the two door bodies 2 are both closed, the turnover beam 3 can be located between the two door bodies 2. In a case where the two door bodies 2 and the turnover beam 3 are all closed, they can jointly seal the storage compartment 11.

In a case where the turnover beam 3 is fixed on the door body 2, a general requirement is that when the door body 2 is closed, the turnover beam 3 is substantially parallel to the door body 2, and when the door body 2 is opened, the turnover beam 3 is substantially perpendicular to the door body 2.

In some embodiments, as shown in FIGS. 4A to 4D, the turnover beam 3 is pivotally connected with the sidewall of the door liner 21 and located on a side of the door seal 22 proximate to the refrigerator body 1. When the door body 2 is closed, a front surface of the turnover beam 3 (e.g., a surface of the turnover beam 3 proximate to the door body 2) can be attached to a back surface of the door seal 22 (e.g., a surface of the door seal 22 proximate to the refrigerator body 1), so that the turnover beam 3 is sealingly engaged with the door seal 22. In this way, it is possible to seal the storage compartment 11 well, reduce heat exchange inside and outside the storage compartment 11, and reduce the energy consumption of the refrigerator 10.

In some embodiments, the door seal 22 includes a magnetic strip. The magnetic strip is disposed on an inner side of the door seal 22, that is, the magnetic strip is located between the door seal 22 and the door liner 21. As shown in FIGS. 5A to 5F, the turnover beam 3 includes a metal plate 31, and the metal plate 31 is located on the front surface of the turnover beam 3 and is configured to attract the magnetic strip. Thus, the door seal 22 can be attached to the front surface of the turnover beam 3 through the magnetic strip, which is beneficial to improve airtightness between the door seal 2 and the turnover beam 3.

As shown in FIGS. 5A to 5F, the refrigerator 10 further includes a hinge mechanism 6, and the turnover beam 3 and the door body 2 are connected through the hinge mechanism 6. The hinge mechanism 6 includes a fixing seat 61 and a mounting seat 62 connected with the fixing seat 61. The fixing seat 61 is disposed on the sidewall of the door liner 21, and the fixing seat 61 is connected with the door liner 21. The mounting seat 62 and the turnover beam 3 are rotatably connected. For example, the mounting seat 62 includes a fitting shaft 621 connected with the turnover beam 3, and the mounting seat 62 is rotatably connected with the turnover beam 3 through the fitting shaft 621, so that the turnover beam 3 can pivot relative to the door body 2 with the fitting shaft 621 serving as an axis of rotation.

In some embodiments, the mounting seat 62 and the fixing seat 61 are detachably connected (e.g., in a plugged-in manner). It will be noted that, a pivoting angle of the turnover beam 3 relative to the door body 2 is substantially 90 degrees (i.e., 90°).

As shown in FIGS. 5A to 5F, the turnover beam 3 includes a turnover beam body 301 and a guide block 32 located on a top of the turnover beam body 301. The guide block 32 protrudes upwards from a top wall of the turnover beam body 301.

As shown in FIGS. 3A to 3D, the refrigerator 10 provided by some embodiments of the present disclosure further includes a guide seat 4. The guide block 32 is configured to be engaged with the guide seat 4 to guide turning over of the turnover beam 3.

Figure 10A:
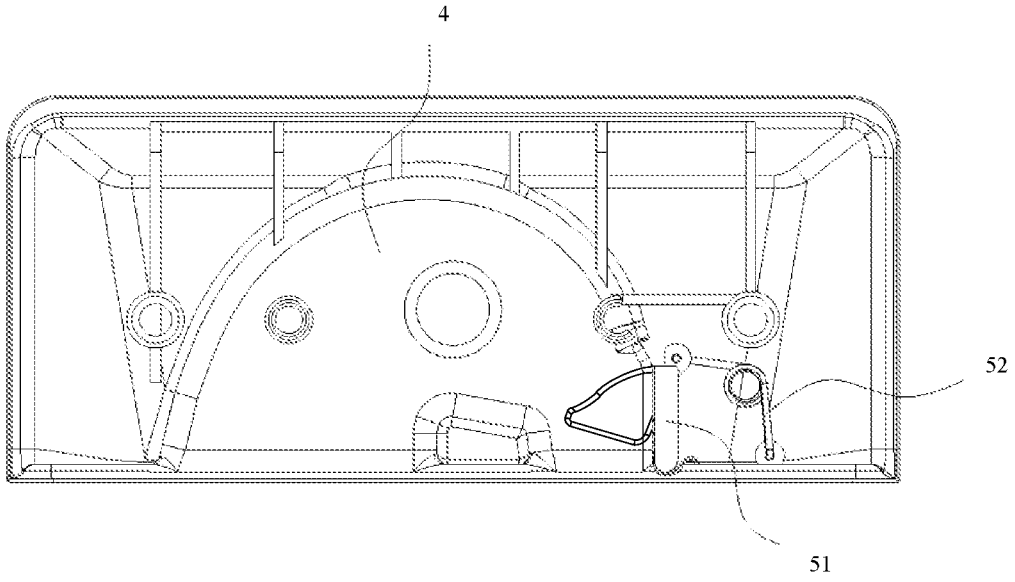
FIG. 10A is a top view of a guide seat of a refrigerator in a state, in accordance with some embodiments.
Figure 10B:
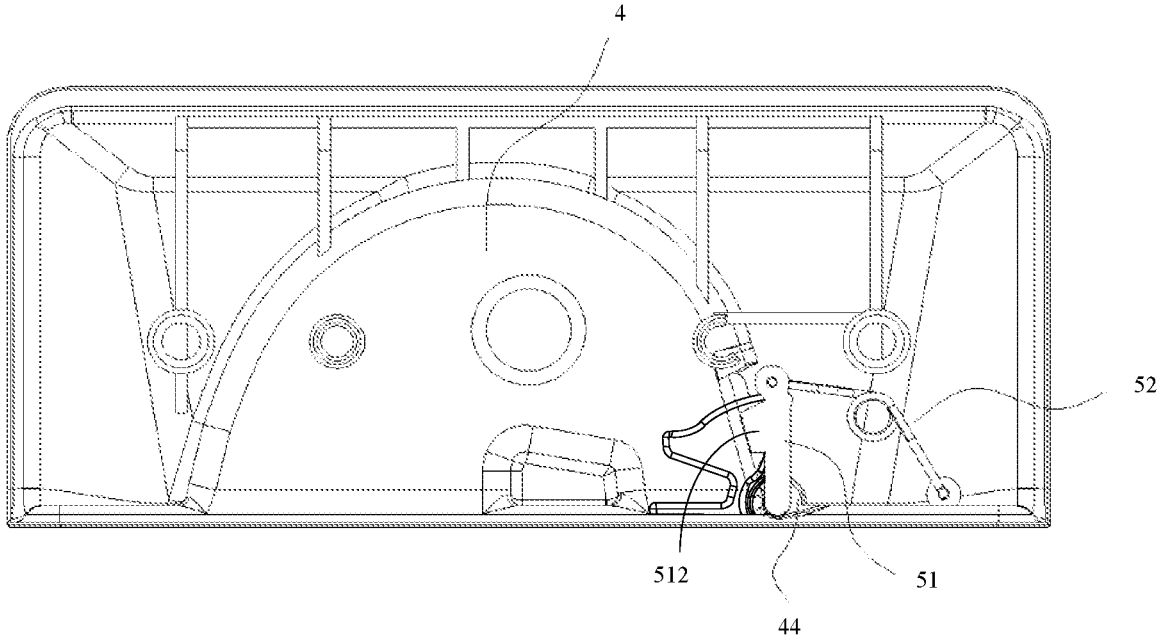
FIG. 10B is a top view of a guide seat of another refrigerator in a state, in accordance with some embodiments.
Figure 10C:
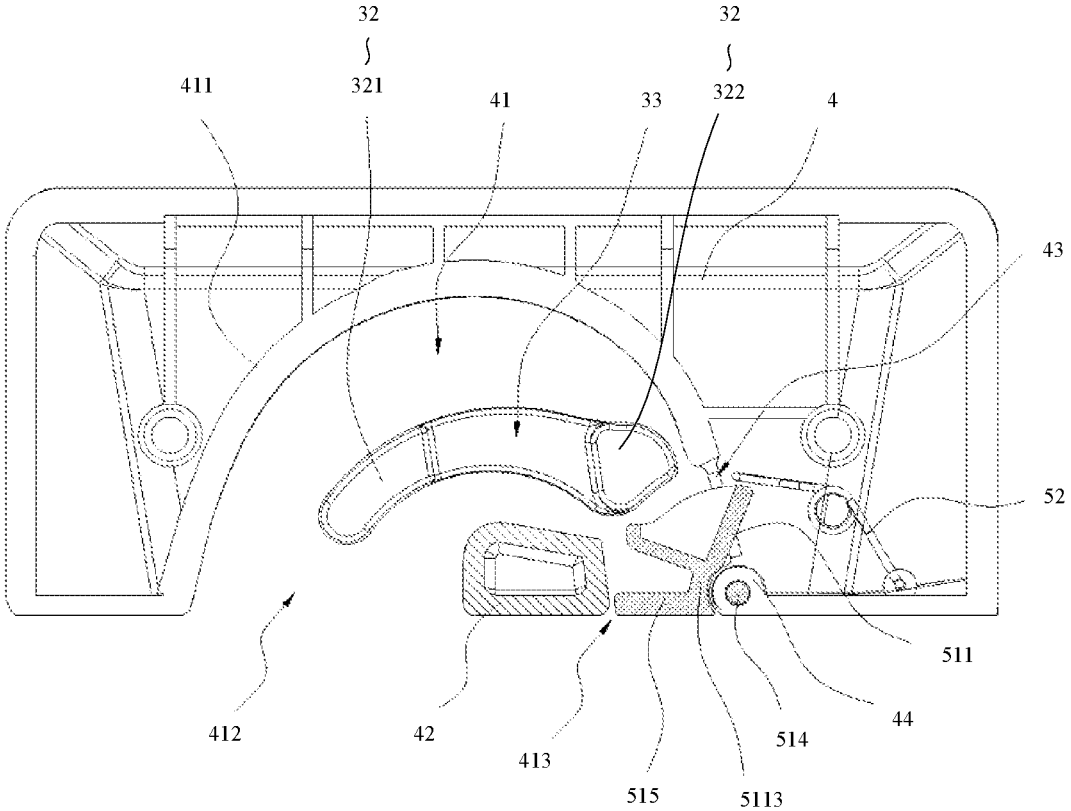
FIG. 10C is a cross-sectional view of FIG. 108.
Figure 11A:
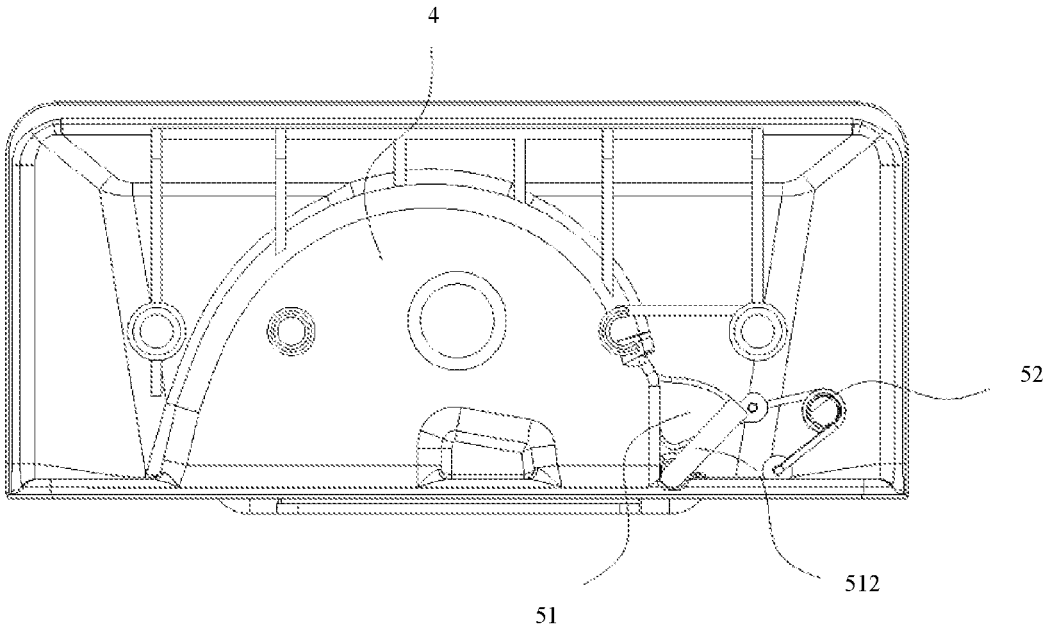
FIG. 11A is a top view of a guide seat of a refrigerator in another state, in accordance with some embodiments.
Figure 11B:
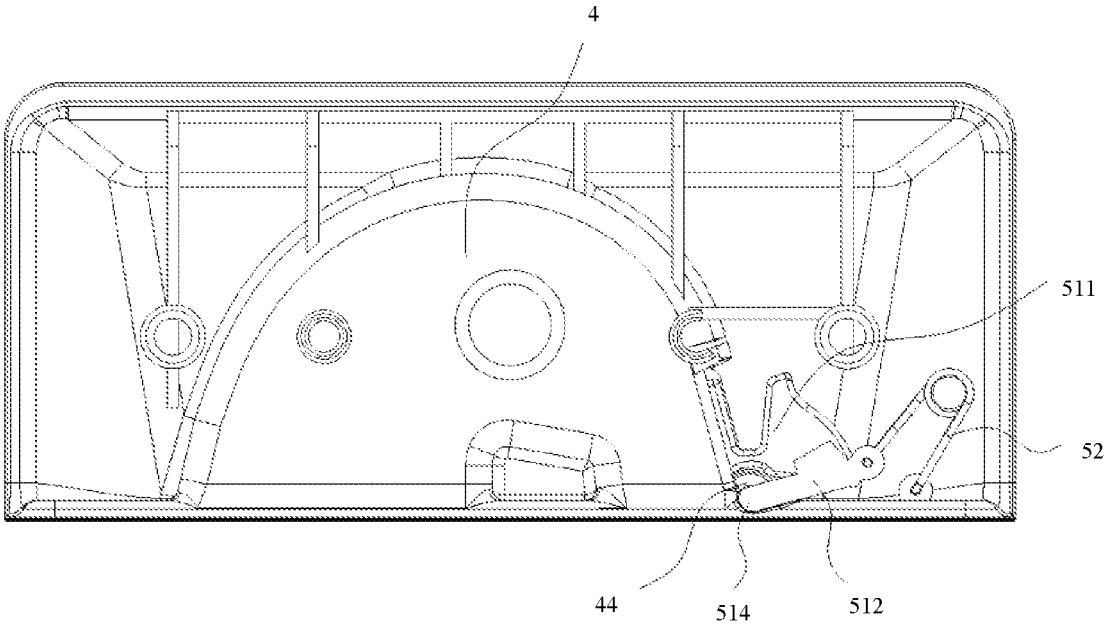
FIG. 11B is a top view of a guide seat of another refrigerator in another state, in accordance with some embodiments.
Figure 11C:
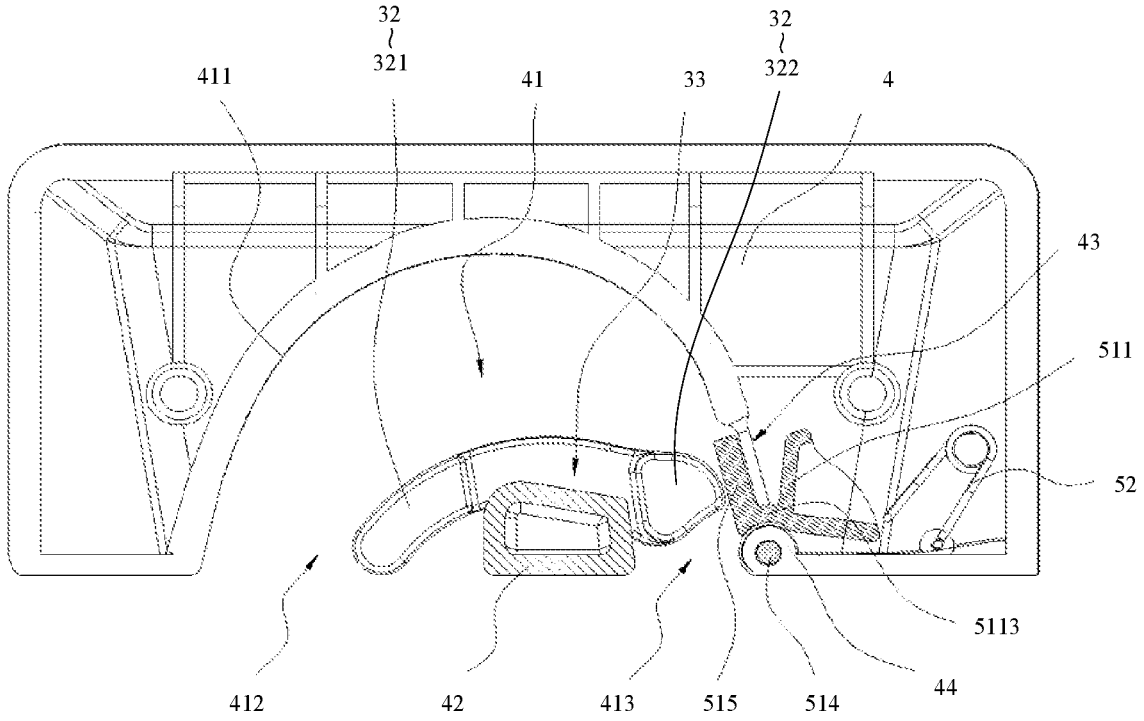
FIG. 11C is a cross-sectional view of FIG. 11B.

In some embodiments, the guide block 32 may be an integral structural member, and an extending direction of the guide block 32 is substantially as shown in FIGS. 10C and 11C. That is, the guide block 32 is a protrusion having a substantially arc shape.

Figure 3B:
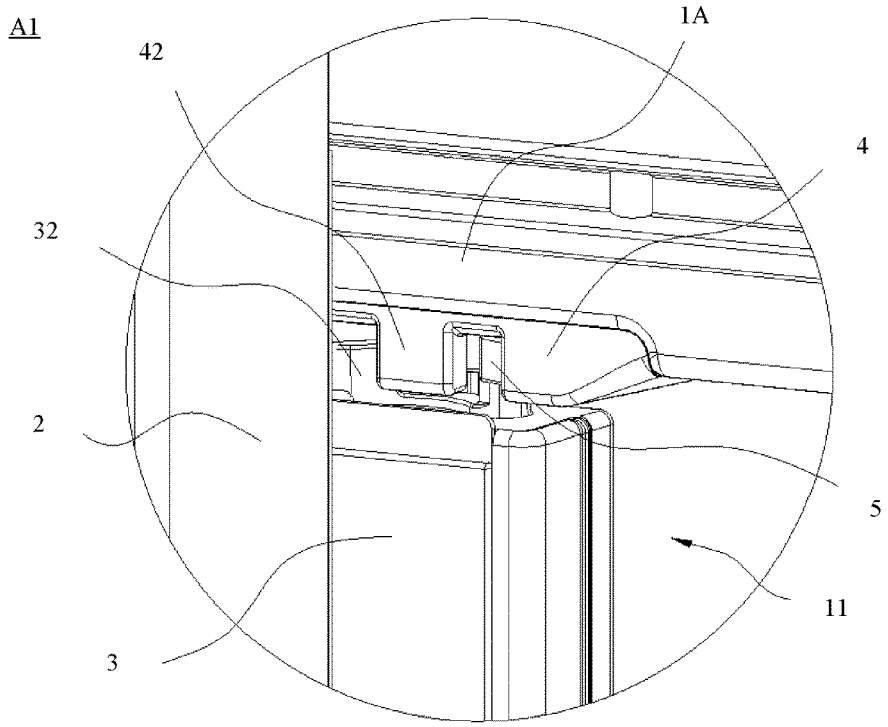
FIG. 3B is a partial enlarged detail of circle A1 in FIG. 3A.
Figure 3C:
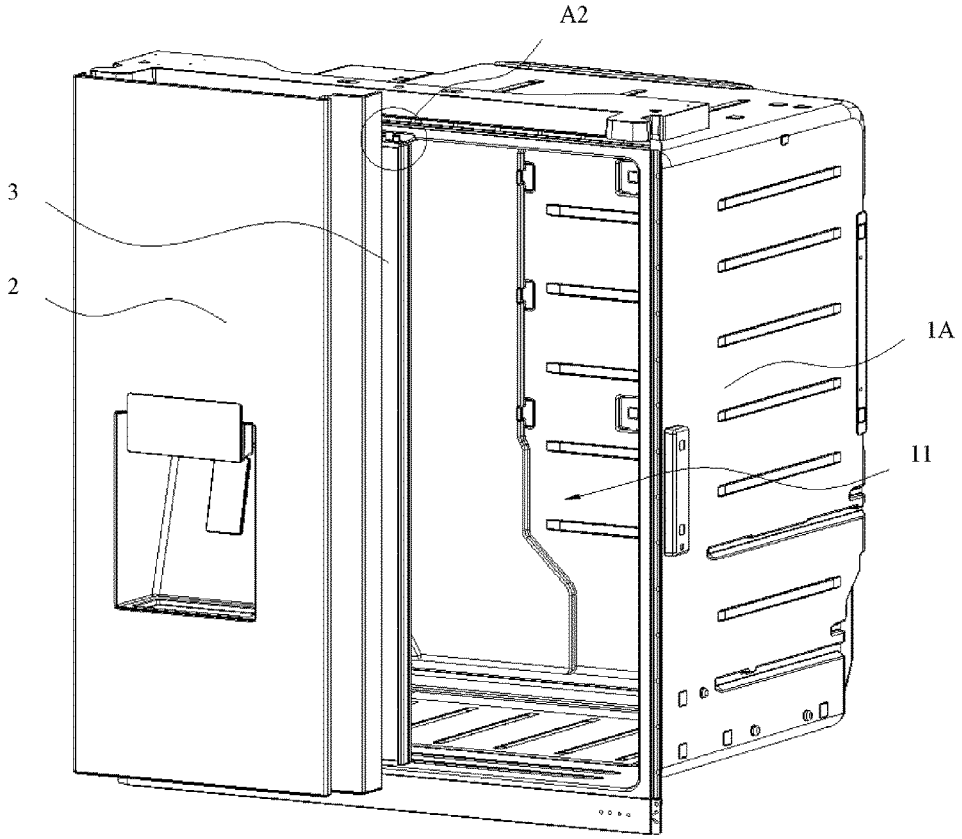
FIG. 3C is a diagram showing a local structure of another refrigerator, in accordance with some embodiments.
Figure 3D:
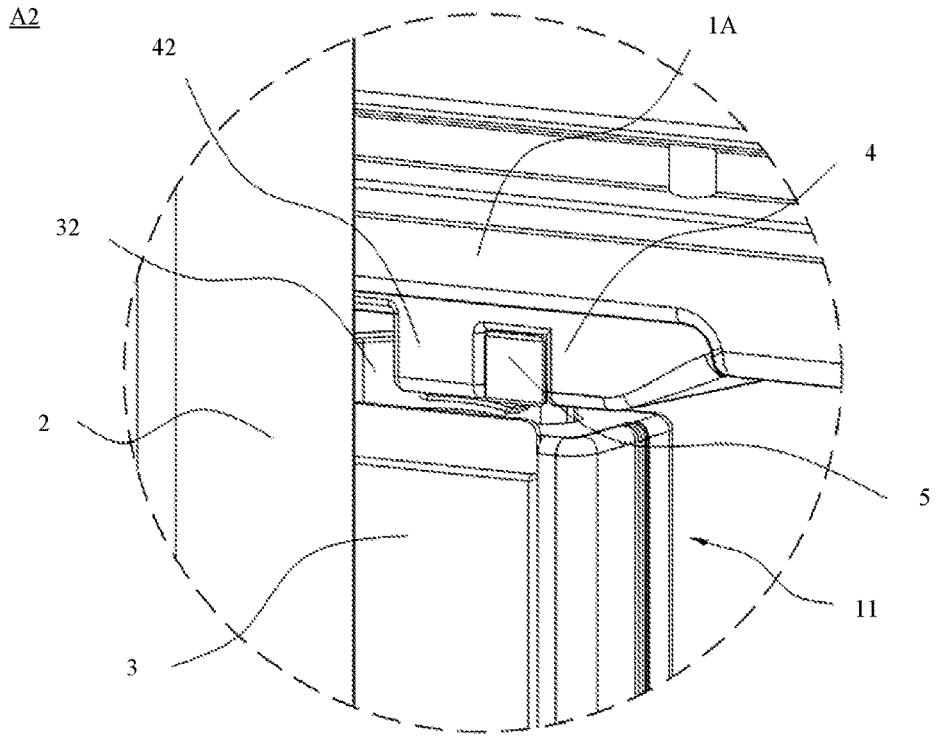
FIG. 3D is a partial enlarged detail of circle A2 in FIG. 3C.
Figure 4A:
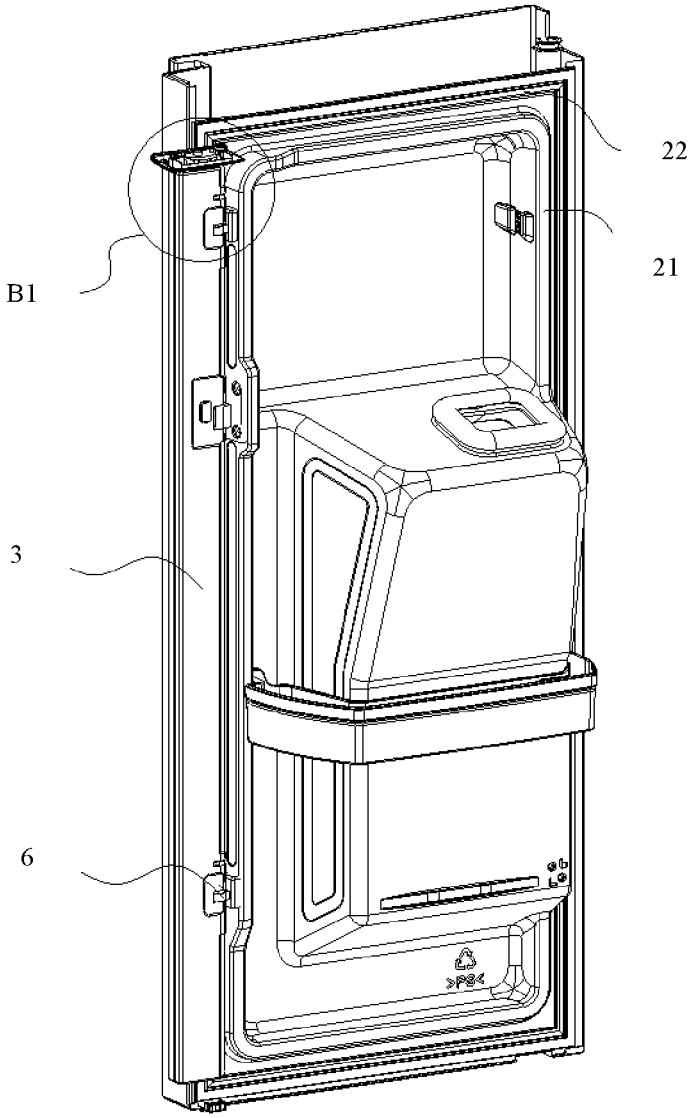
FIG. 4A is a diagram showing structures of a door body, a turnover beam, and a guide seat of a refrigerator, in accordance with some embodiments.
Figure 4B:
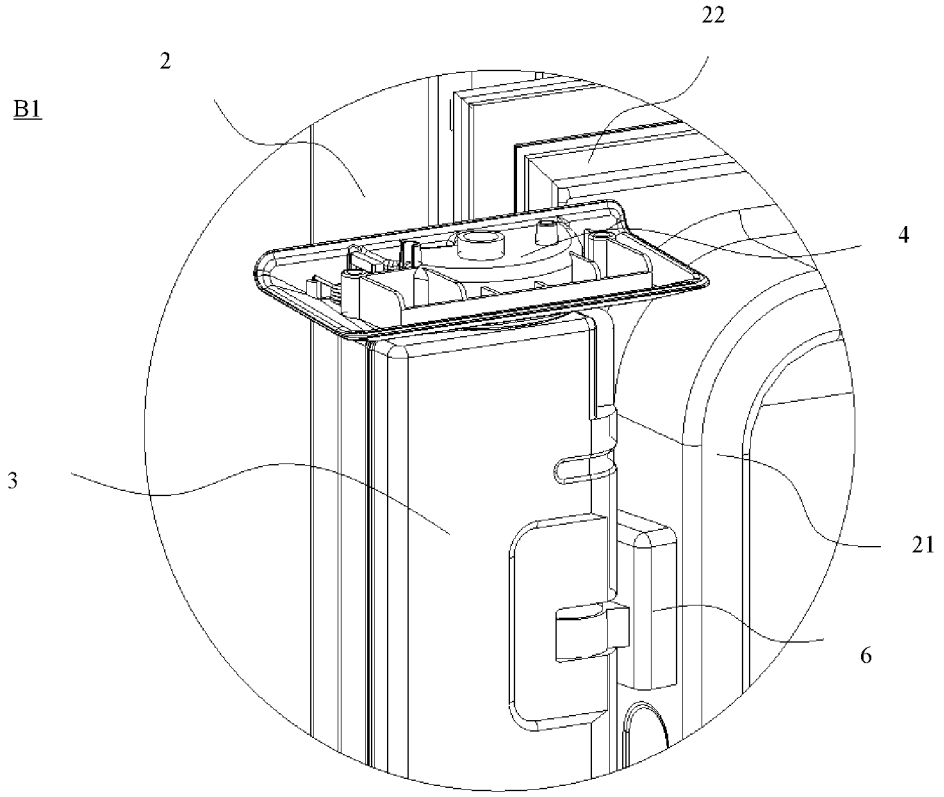
FIG. 4B is a partial enlarged detail of circle B1 in FIG. 4A.
Figure 4C:
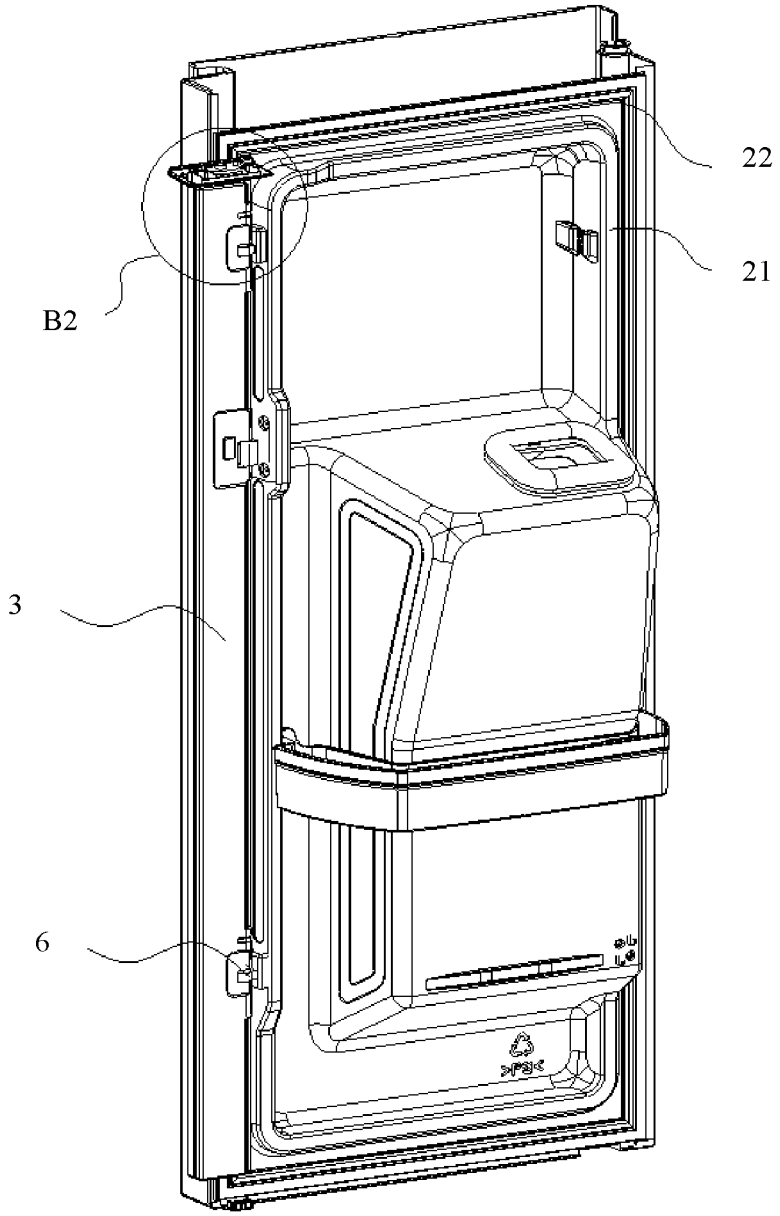
FIG. 4C is a diagram showing structures of a door body, a turnover beam, and a guide seat of another refrigerator, in accordance with some embodiments.
Figure 4D:
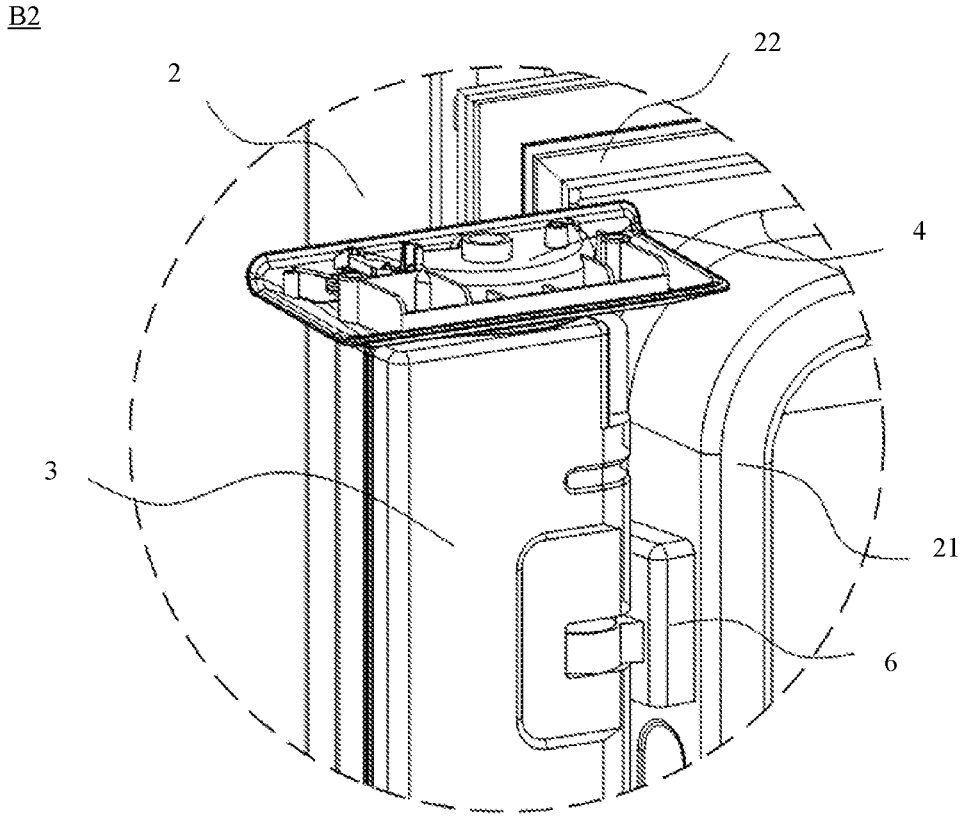
FIG. 4D is a partial enlarged detail of circle B2 in FIG. 4C.

As shown in FIGS. 3B and 3D, the guide seat 4 is disposed on a top of the storage compartment 11. For example, the guide seat 4 is fixed on a top wall of the refrigerator liner 1A. The guide seat 4 and the turnover beam 3 are at least partially opposite to each other in the height direction of the refrigerator 10. In a case where the door body 2 and the turnover beam 3 are both closed, the guide seat 4 is located on a top of the turnover beam 3.

Figure 5A:
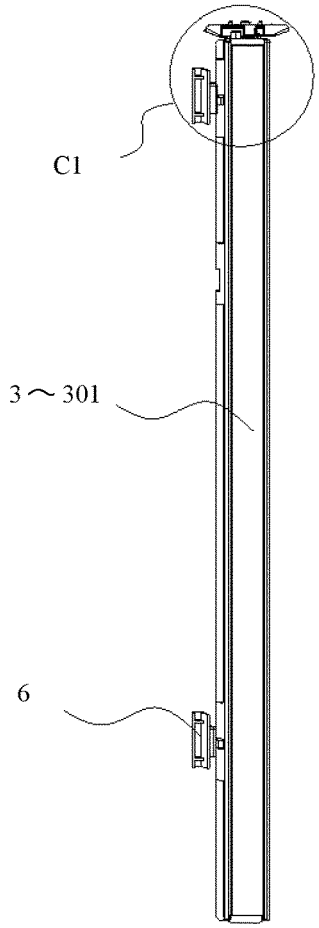
FIG. 5A is a diagram showing structures of a turnover beam and a guide seat of a refrigerator, in accordance with some embodiments.
Figure 5B:
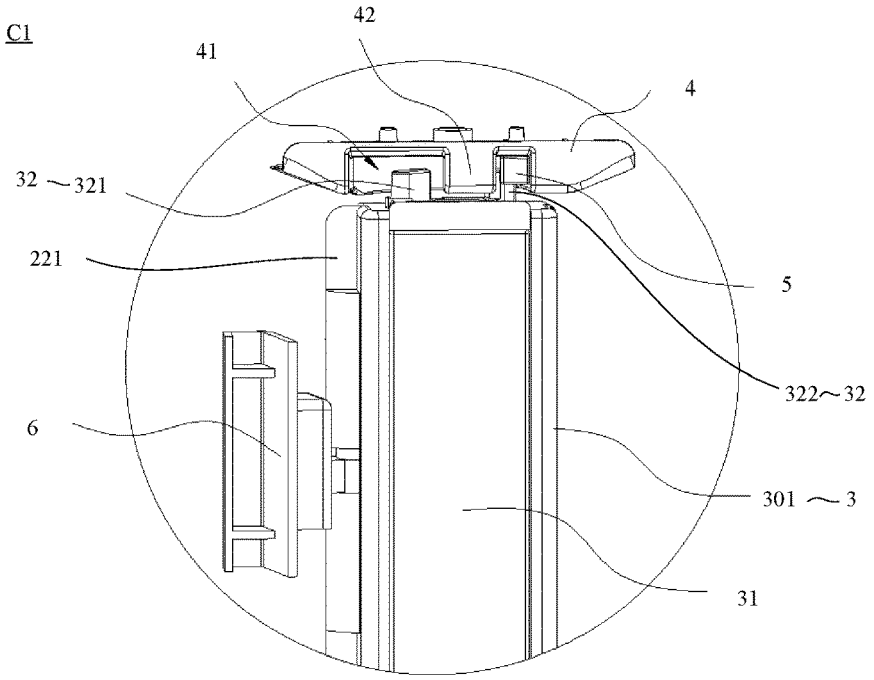
FIG. 5B is a partial enlarged detail of circle C1 in FIG. 5A.
Figure 5C:
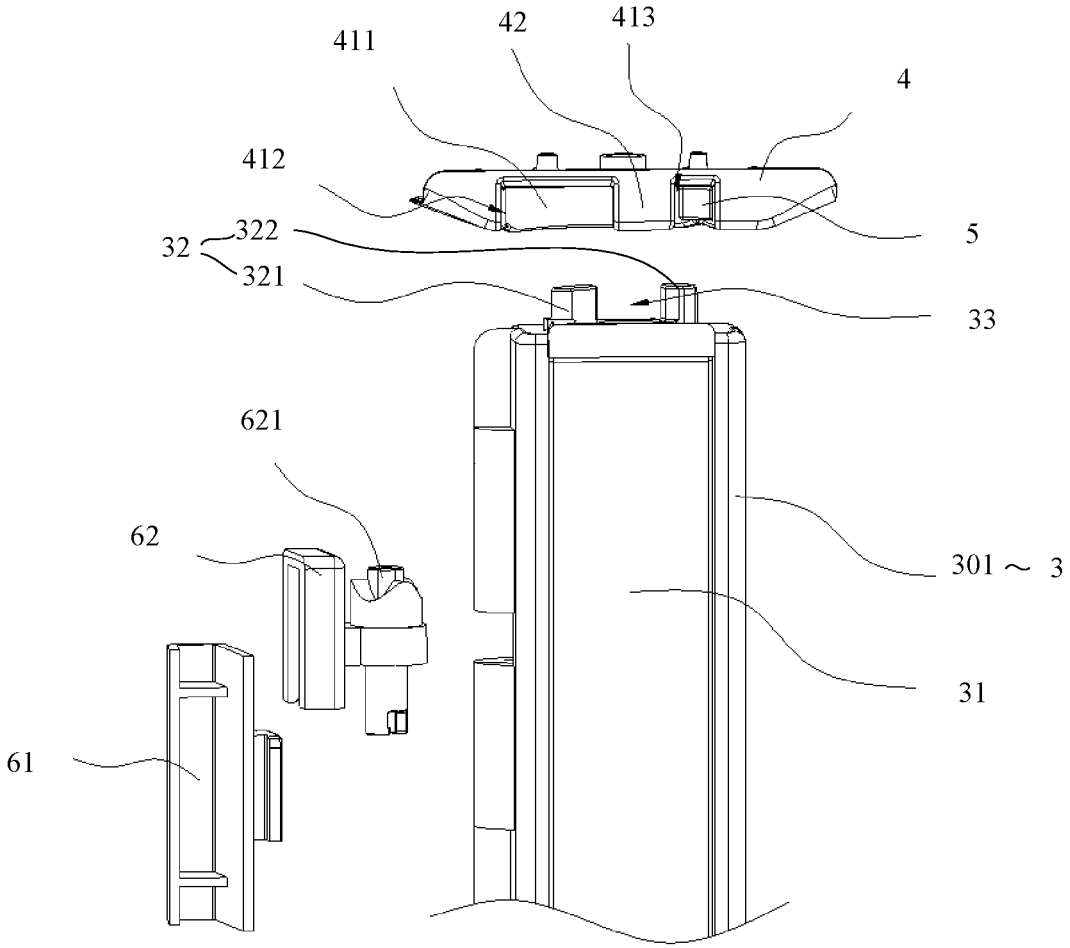
FIG. 5C is an exploded view of FIG. 5B.
Figure 5D:
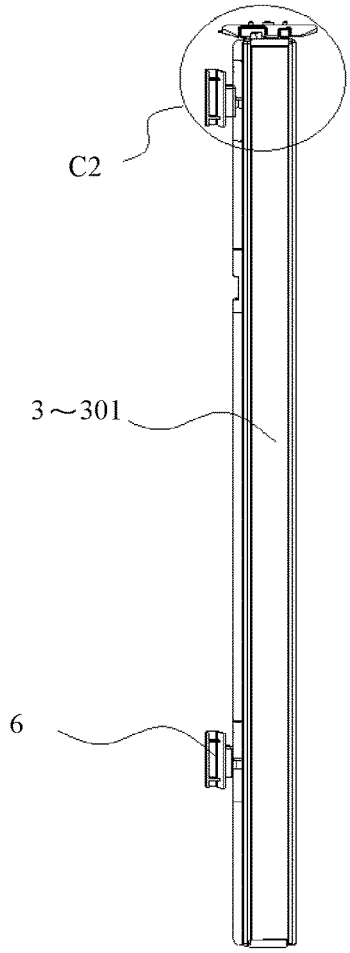
FIG. 5D is a diagram showing structures of a turnover beam and a guide seat of another refrigerator, in accordance with some embodiments.
Figure 5E:
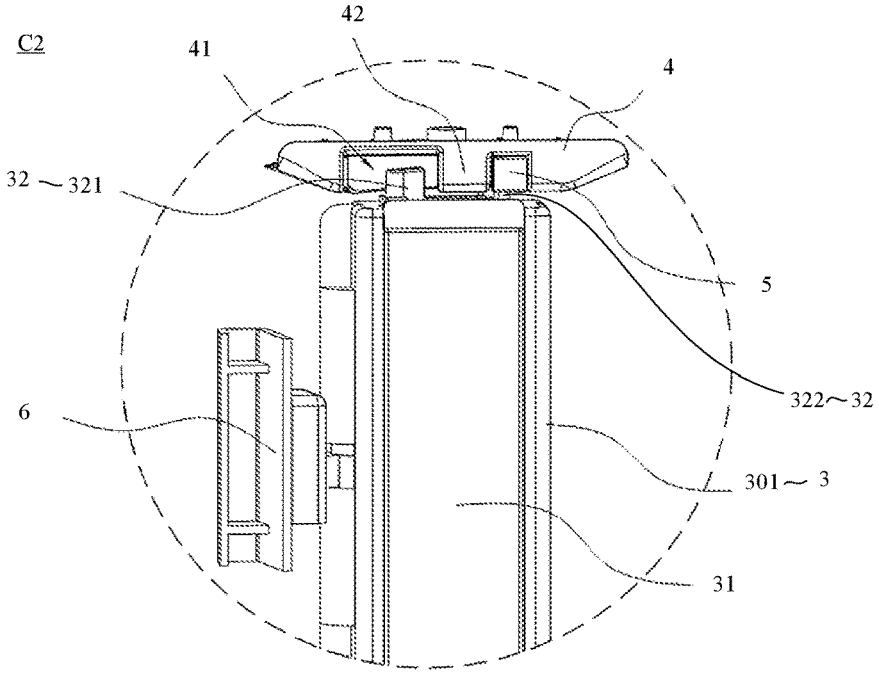
FIG. 5E is a partial enlarged detail of circle C2 in FIG. 5D.
Figure 6A:
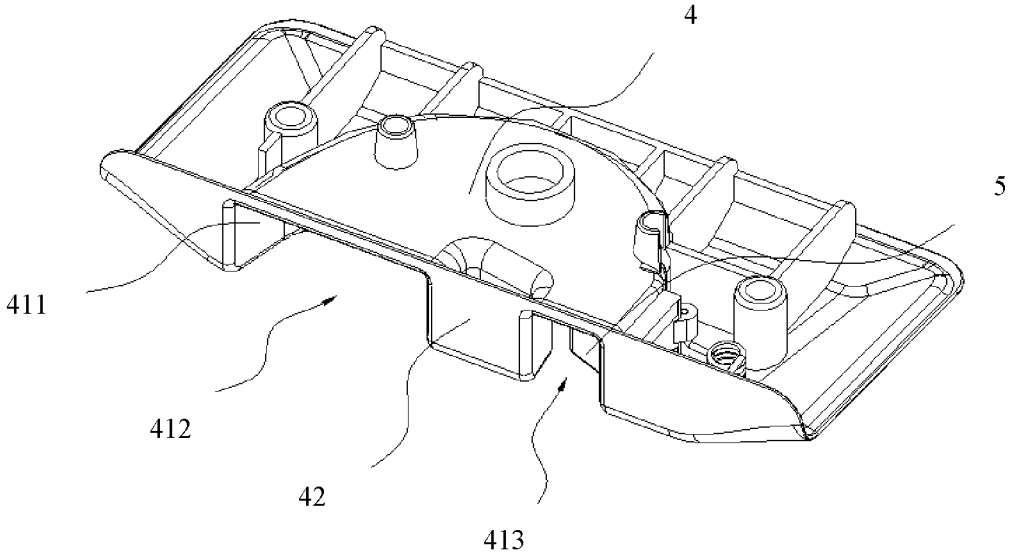
FIG. 6A is a diagram showing a structure of a guide seat of a refrigerator, in accordance with some embodiments.
Figure 6B:
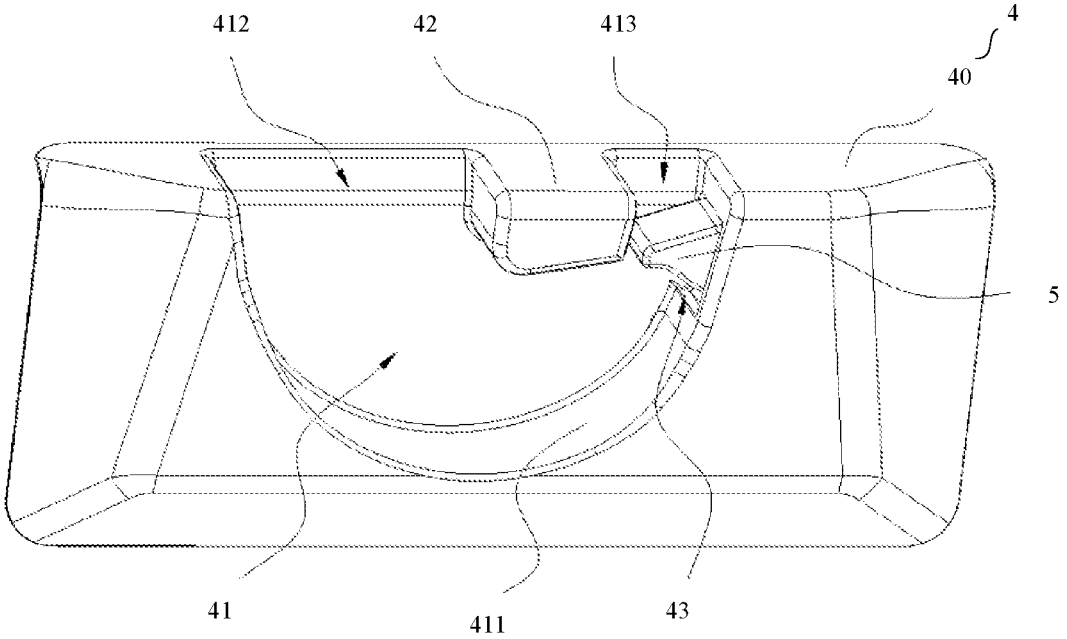
FIG. 6B is a diagram showing a structure of the guide seat in FIG. 6A from another perspective.
Figure 6C:
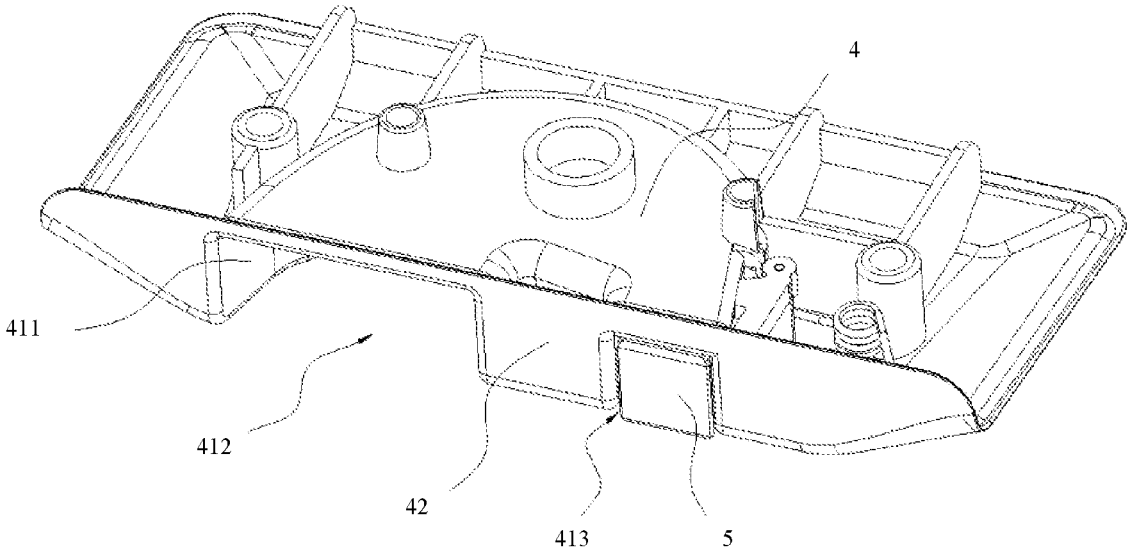
FIG. 6C is a diagram showing a structure of another guide seat of a refrigerator, in accordance with some embodiments.
Figure 6D:
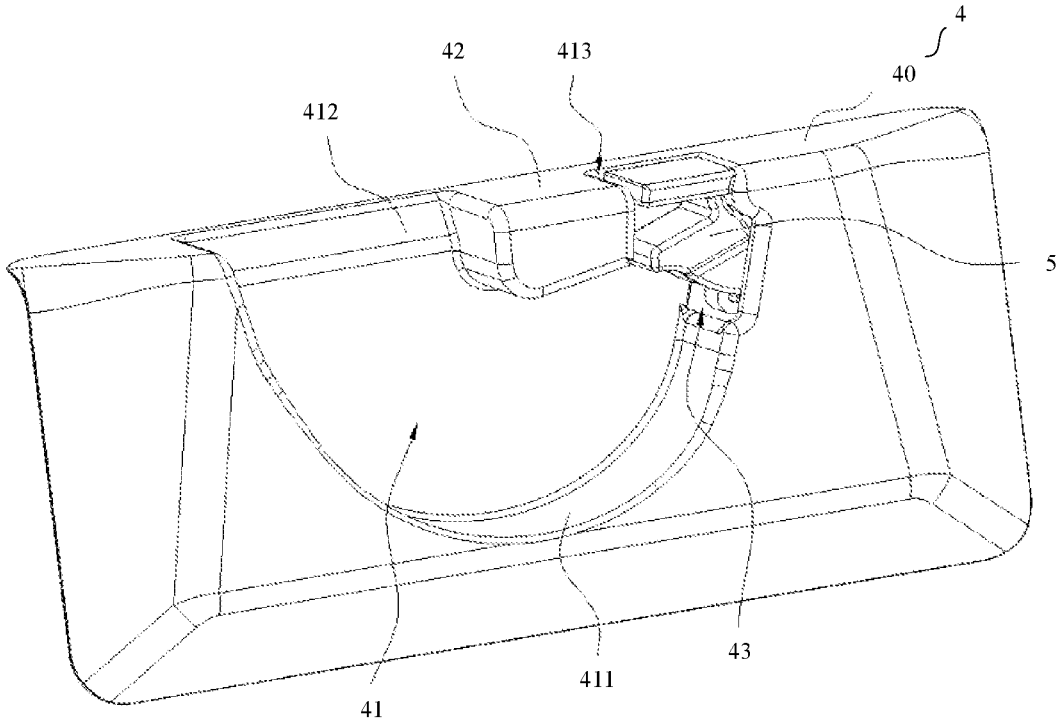
FIG. 6D is a diagram showing a structure of the guide seat in FIG. 6C from another perspective.

As shown in FIGS. 5B and 5E, the guide seat 4 includes a guide seat body 40 (as shown in FIGS. 6B and 6D) and a guide groove 41 disposed in the guide seat body 40. The guide groove 41 is configured to match with the guide block 32. As shown in FIGS. 6B and 6D (FIGS. 6B and 6D are roughly figures obtained when an observer looks up), the guide groove 41 is open at a bottom thereof and includes a front side opening. In a case where the door body 2 and the turnover beam 3 are closed, the guide block 32 can enter the guide groove 41 from the front side opening, so that the guide block 32 moves along the guide groove 41.

As shown in FIGS. 6A to 6D, the guide groove 41 includes a guide wall 411. The guide wall 411 may be an inner sidewall of the guide groove 41, and the guide wall 411 has a curved surface structure in a substantially circular-arc-shape. In a case where the guide block 32 enters the guide groove 41, the guide block 32 can move along the guide wall 411, thereby driving the turnover beam 3 to turn over to achieve the closing of the door body 2 and the turnover beam 3.

Figure 7A:
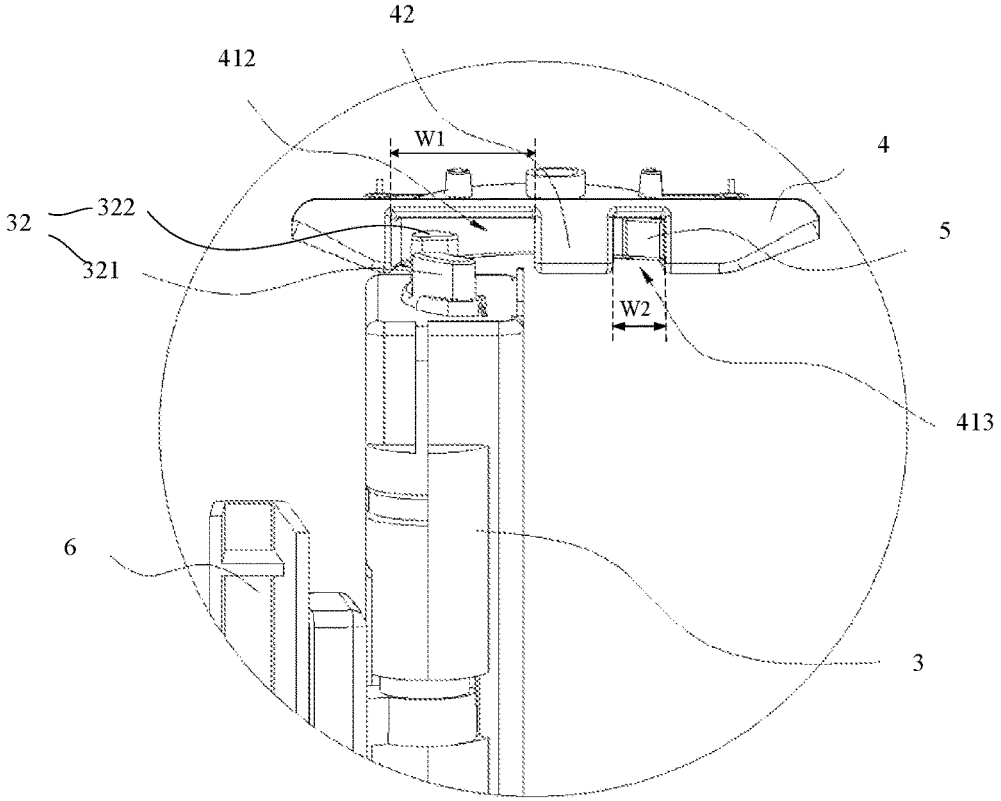
FIG. 7A is a structural diagram when a turnover beam of a refrigerator is normally opened or closed, in accordance with some embodiments.
Figure 7B:
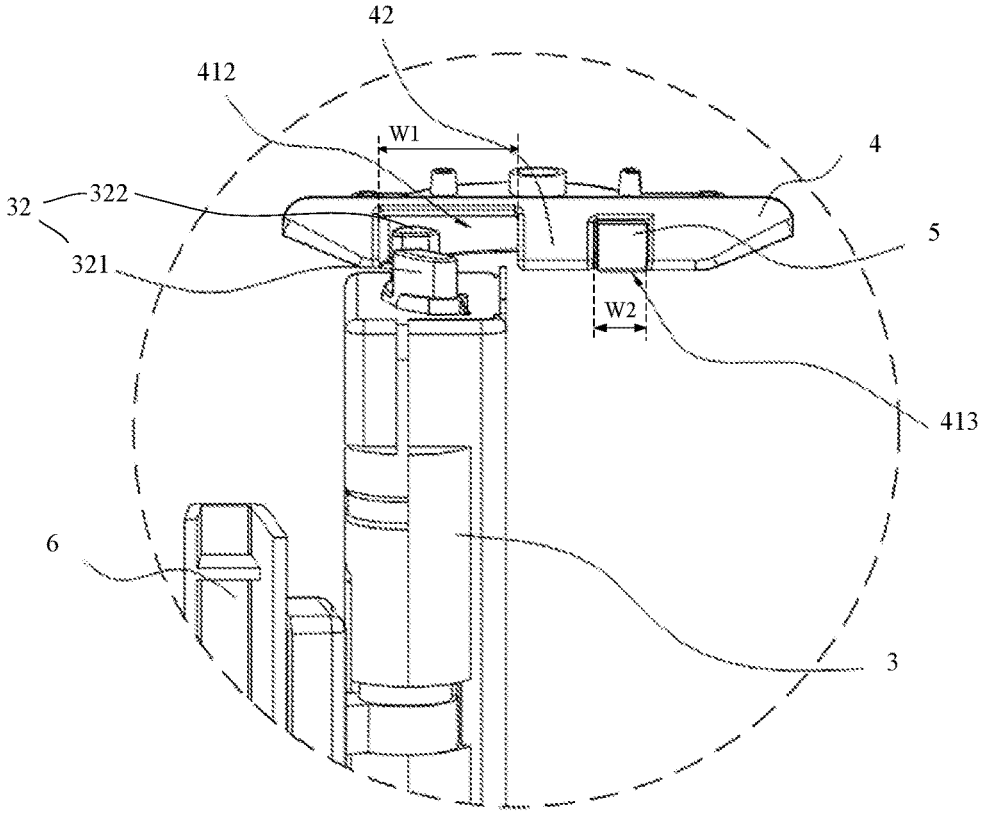
FIG. 7B is a structural diagram when a turnover beam of another refrigerator is normally opened or closed, in accordance with some embodiments.

It will be noted that in a case where the turnover beam 3 completely enters the guide groove 41, the door body 2 and the turnover beam 3 are in a closed state, and the turnover beam 3 and the door body 2 are substantially parallel (as shown in FIGS. 3B and 3D). In a case where the turnover beam 3 exits the guide groove 41, the door body 2 and the turnover beam 3 are in an open state, and the turnover beam 3 is substantially perpendicular to the door body 2 (as shown in FIGS. 7A and 7B).

In some embodiments, as shown in FIGS. 6A to 6D, the guide seat 4 further includes a partition block 42 located at the front side opening of the guide groove 41, and the partition block 42 extends downwards from a top wall of the guide seat body 40, so as to partition the front side opening into a first inlet 412 and a second inlet 413. In some embodiments, the first inlet 412 and the second inlet 413 are spaced apart in a left-and-right direction of the guide seat body 40.

In some embodiments, the guide block 32 includes a first portion 321 and a second portion 322. The first inlet 412 is configured to allow the guide block 32 to enter and exit the guide groove 41 when the turnover beam 3 is normally closed or opened, and to allow the second portion 322 of the guide block 32 to enter the guide groove 41 when the turnover beam 3 is abnormally closed. For example, in a case where the door body 2 and the turnover beam 3 are normally closed, both the second portion 322 and the first portion 321 of the guide block 32 enter the guide groove 41 from the first inlet 412, and the guide block 32 can move along the guide wall 411, thereby driving the turnover beam 3 to turn over to achieve a normal closing of the turnover beam 3. In a case where both the first portion 321 and the second portion 322 of the guide block 32 exit the guide groove 41 from the first inlet 412, the turnover beam 3 is normally opened.

Figure 5F:
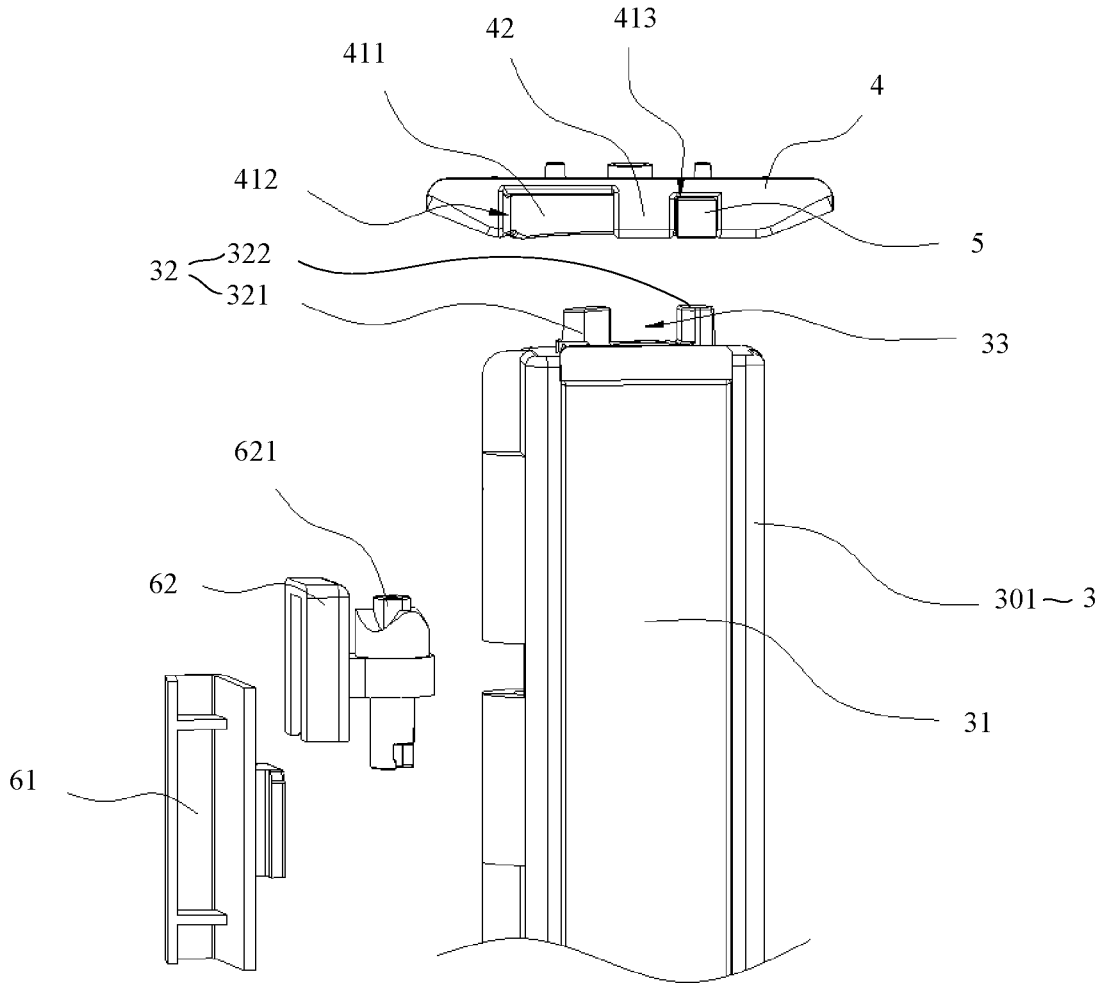
FIG. 5F is an exploded view of FIG. 5E.

The second inlet 413 is configured to allow the second portion 322 of the guide block 32 to enter the guide groove 41 when the turnover beam 3 is abnormally closed. As shown in FIGS. 5C and 5F, the guide block 32 includes the first portion 321, the second portion 322, and an avoidance groove 33. The avoidance groove 33 is located between the first portion 321 and the second portion 322, and the avoidance groove 33 is configured to avoid the partition block 42. In a case where the turnover beam 3 is abnormally closed, the avoidance groove 33 avoids the partition block 42, so that the first portion 321 of the guide block 32 enters the guide groove 41 from the first inlet 412 and the second portion 322 enters the guide groove 41 from the second inlet 413 simultaneously.

In some embodiments, as shown in FIGS. 10C and 11C, the avoidance groove 33 is substantially located at a middle position of the guide block 32, and the avoidance groove 33 and the guide block 42 are arranged opposite to each other in a front-and-rear direction of the guide seat 4.

It will be noted that as shown in FIGS. 5C and 5F, the first inlet 412 is located on a side proximate to the hinge mechanism 6, and the second inlet 413 is located on a side away from the hinge mechanism 6. As shown in FIGS. 7A and 7B, a width W2 of the second inlet 413 in the left-and-right direction is smaller than a width W1 of the first inlet 412 in the left-and-right direction. Therefore, in a case where the turnover beam 3 is opened with the door body 2, the guide block 32 on the top of the turnover beam 3 cannot exit the guide groove 41 from the second inlet 413.

In some embodiments, as shown in FIGS. 6A to 6D, the refrigerator 10 further includes a limiting block 5 that is rotatably connected with the guide seat body 40, and the limiting block 5 is configured to substantially close the second inlet 413. Therefore, a cooperation of the limiting block 5 and the partition block 42 can limit the guide block 32, so as to confine the guide block 32 in the guide groove 41.

In a case where the guide block 32 is located in the guide groove 41 and the door body 2 drives the turnover beam 3 to close in a normal state (as shown in FIGS. 58 and 5E), the guide block 32 can be limited by the limiting block 5 and the partition block 42 together. This prevents the guide block 32 from exiting the guide groove 41 from the second inlet 413. In a case where the door body 2 is required to drive the turnover beam 3 to open in a normal state, the guide block 32 exits from a rear side surface of the limiting block 5 and a rear side surface of the partition block 42 and moves toward the first inlet 412, and finally exits the guide groove 41 from the first inlet 412 (as shown in FIGS. 7A and 7B), thereby achieving the normal opening of the turnover beam 3. The rear side surface of the limiting block 5 is, for example, a side surface of the limiting block 5 away from the door body 20, and the rear side surface of the partition block 42 is, for example, a side surface of the partition block 42 away from the door body 20.

In a case where the guide block 32 is located outside the guide groove 41 and the door body 2 drives the turnover beam 3 to open in the normal state, the turnover beam 3 is substantially perpendicular to the door body 2 (as shown in FIGS. 7A and 78). In a case where the door body 2 drives the turnover beam 3 to close in the normal state, both the second portion 322 and the first portion 321 of the guide block 32 can enter the guide groove 41 from the first inlet 412, and move along the guide wall 411, thereby driving the turnover beam 3 to turn over to achieve the normal closing of the door body 2 and the turnover beam 3.

Figure 8A:
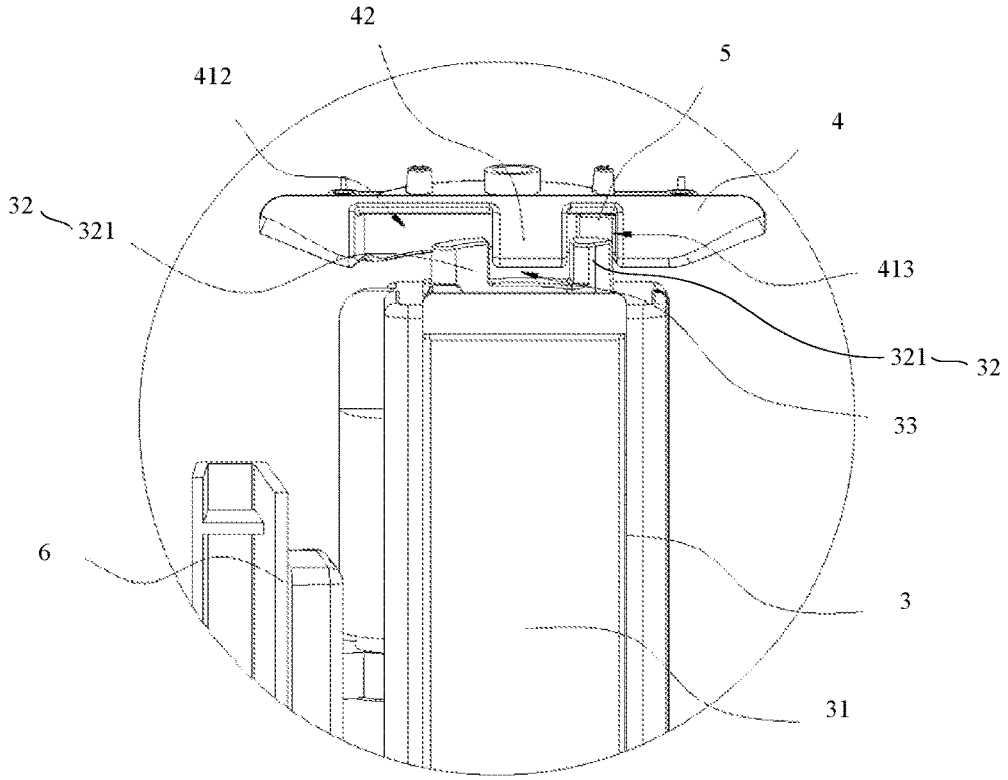
FIG. 8A is a structural diagram when a turnover beam of a refrigerator is abnormally closed, in accordance with some embodiments.
Figure 8B:
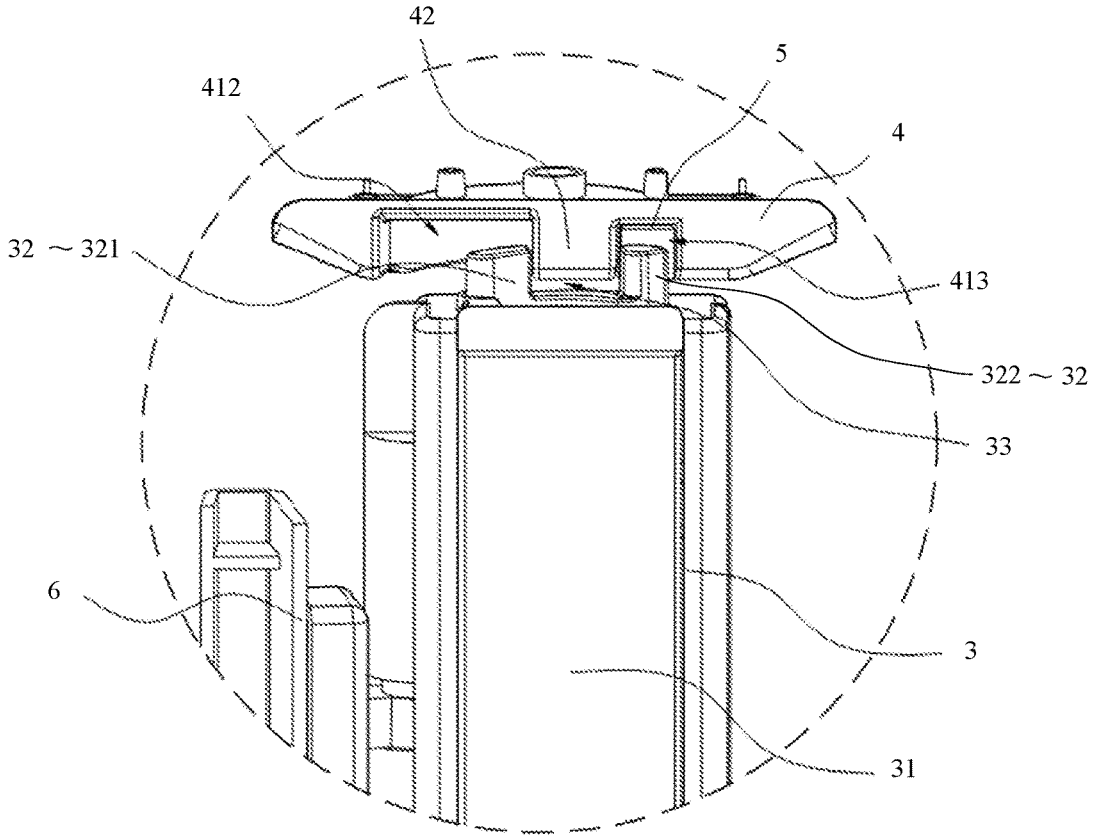
FIG. 8B is a structural diagram when a turnover beam of another refrigerator is abnormally closed, in accordance with some embodiments.

As shown in FIGS. 8A and 88, in a case where the guide block 32 is located outside the guide groove 41 and the door body 2 drives the turnover beam 3 to close in an abnormal state, the turnover beam 3 and the door body 2 are substantially parallel. In this case, the avoidance groove 33 avoids the partition block 42, and the guide block 32 enters the guide groove 41 from the first inlet 412 and the second inlet 413 simultaneously. For example, the first portion 321 of the guide block 32 enters the guide groove 41 from the first inlet 412, and the second portion 322 of the guide block 32 presses the limiting block 5 at the second inlet 413, and forces the limiting block 5 to pivot and exit the guide groove 41, and finally the second portion 322 enters the guide groove 41 from the second inlet 413. In addition, in a case where the second portion 322 of the guide block 32 completely enters the guide groove 41, the limiting block 5 is reset to limit the guide block 32, so that the turnover beam 3 can be closed even in an abnormal operation.

It will be understood that a way to limit the guide block 32 by the cooperation of the partition block 42 and the limiting block 5 can greatly reduce a length of the limiting block 5 extending into the guide groove 41 (e.g., the length is substantially equal to the width W2 of the second inlet 413), which is beneficial to reduce a size and rotational stroke of the limiting block 5 and improve a stability and reliability of the movement of the guide block 32.

Of course, in some embodiments, the guide seat 4 may not be provided with the partition block 42 partitioning the front side opening. In this case, the limiting block 5 may directly pivot and extend into the front side opening of the guide groove 41 to limit the guide block 32, which may simplify a structure of the guide seat 4.

For ease of description, some embodiments of the present disclosure are mainly described by taking an example in which the guide seat 4 is provided with the partition block 42. However, this should not be construed as a limitation on the present disclosure.

As shown in FIGS. 10C and 11C, the guide seat 4 further includes an opening 43 configured to allow the limiting block 5 to pass through. In a case where the turnover beam 3 is normally closed or opened, the limiting block 5 is configured to pass through the opening 43 and stop at the second inlet 413 of the guide groove 41. In a case where the turnover beam 3 is abnormally closed, the second portion 322 of the guide block 32 can press the limiting block 5 and make the limiting block 5 exit the guide groove 41 through the opening 43 and make the second portion 322 enter the guide groove 41 from the second inlet 413. In addition, in a case where the second portion 322 completely enters the guide groove 41, the limiting block 5 is reset to limit the guide block 32, so that the turnover beam 3 can also be closed even in the abnormal operation.

In some embodiments, as shown in FIGS. 6A to 6D, the opening 43 is disposed on a peripheral wall of the guide groove 41 proximate to the second inlet 413. For example, the opening 43 is located at a position on the guide wall 411 proximate to the second inlet 413. The limiting block 5 rotatably passes through the opening 43, and the limiting block 5 can pivot and extend into the guide groove 41 through the opening 43.

In a case where the limiting block 5 extends into the guide groove 41 and the partition block 42 is disposed on the guide seat 4, a free end of the limiting block 5 is proximate to the partition block 42. Moreover, as shown in FIGS. 10A and 108, the rear side surface of the limiting block 5 can smoothly meet the rear side surface of the partition block 42, so that the limiting block 5 and the partition block 42 are cooperated to jointly limit the guide block 32. In a case where the turnover beam 3 is opened, the guide block 32 can move away from the rear side surface of the limiting block 5 and the rear side surface of the partition block 42, move toward the first inlet 412, and finally exit the guide groove 41 from the first inlet 412 to achieve the opening of the turnover beam 3.

It will be understood that the opening 43 is not limited to be disposed on the guide wall 411.

In some embodiments, the guide seat 4 includes the guide seat body 40 (as shown in FIGS. 6B and 6D), and the opening 43 is disposed at a position on the top wall of the guide seat body 40 and proximate to the second inlet 413. The limiting block 5 rotatably passes through the opening 43 and is located on the top of the guide seat body 40. The limiting block 5 can pivot and extend into the guide groove 41 through the opening 43, so that the limiting block 5 is cooperated with the partition block 42 to jointly limit the guide block 32.

In some embodiments, in a case where the guide seat 4 is provided with the partition block 42, the opening 43 may also be disposed on a sidewall of the partition block 42 proximate to the second inlet 413. The limiting block 5 rotatably passes through the opening 43 and is located inside the partition block 42. The limiting block 5 can pivot and extend into the second inlet 413 through the opening 43, so that the limiting block 5 is cooperated with the partition block 42 to jointly limit the guide block 32.

Figure 9A:
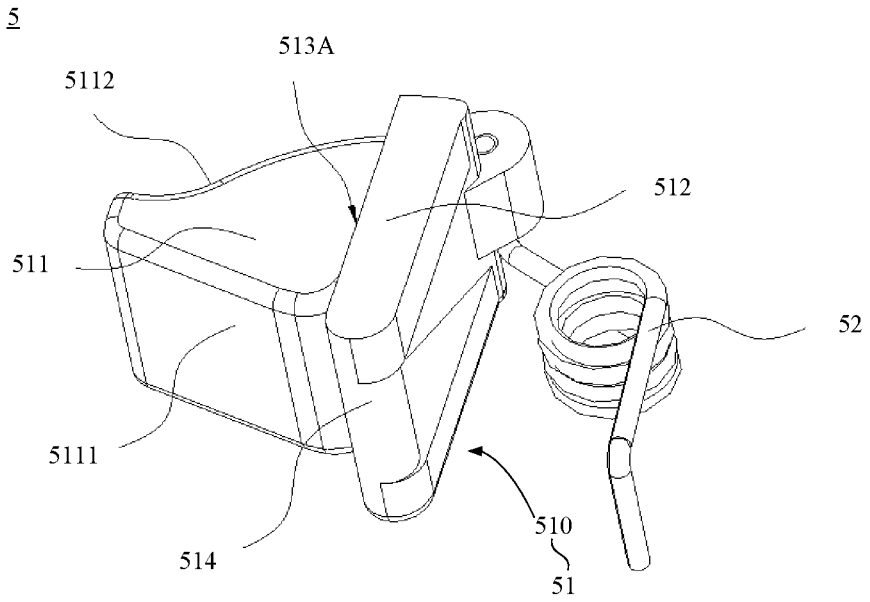
FIG. 9A is a diagram showing a structure of a limiting block of a refrigerator, in accordance with some embodiments.
Figure 9B:
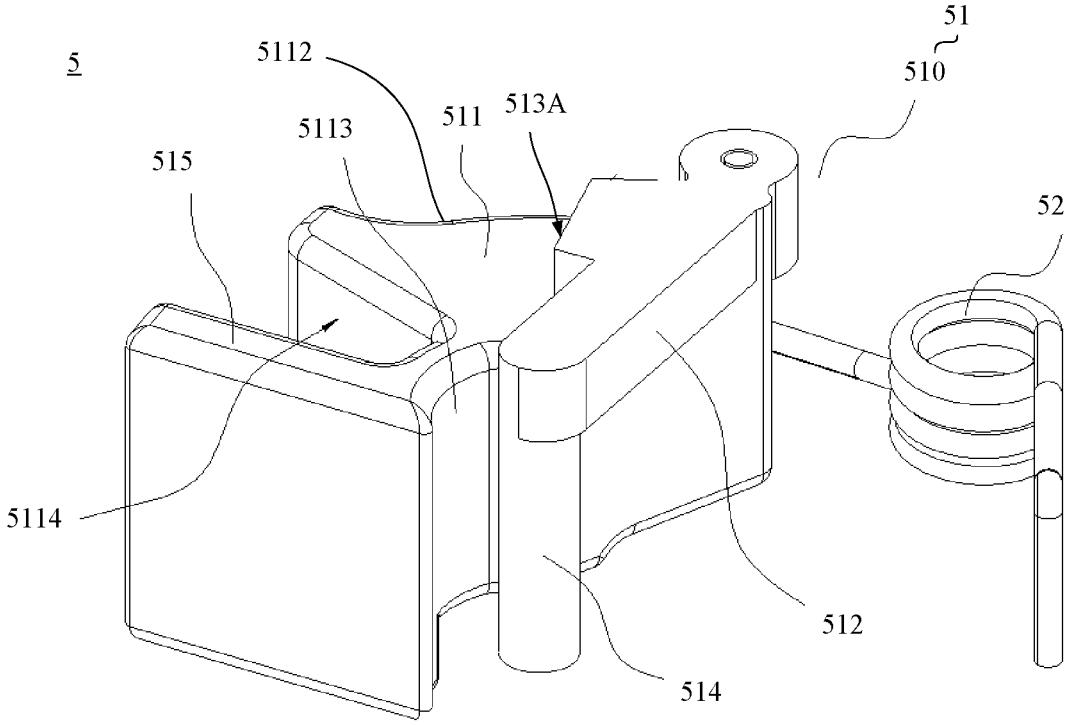
FIG. 9B is a diagram showing a structure of another limiting block of a refrigerator, in accordance with some embodiments.
Figure 9C:
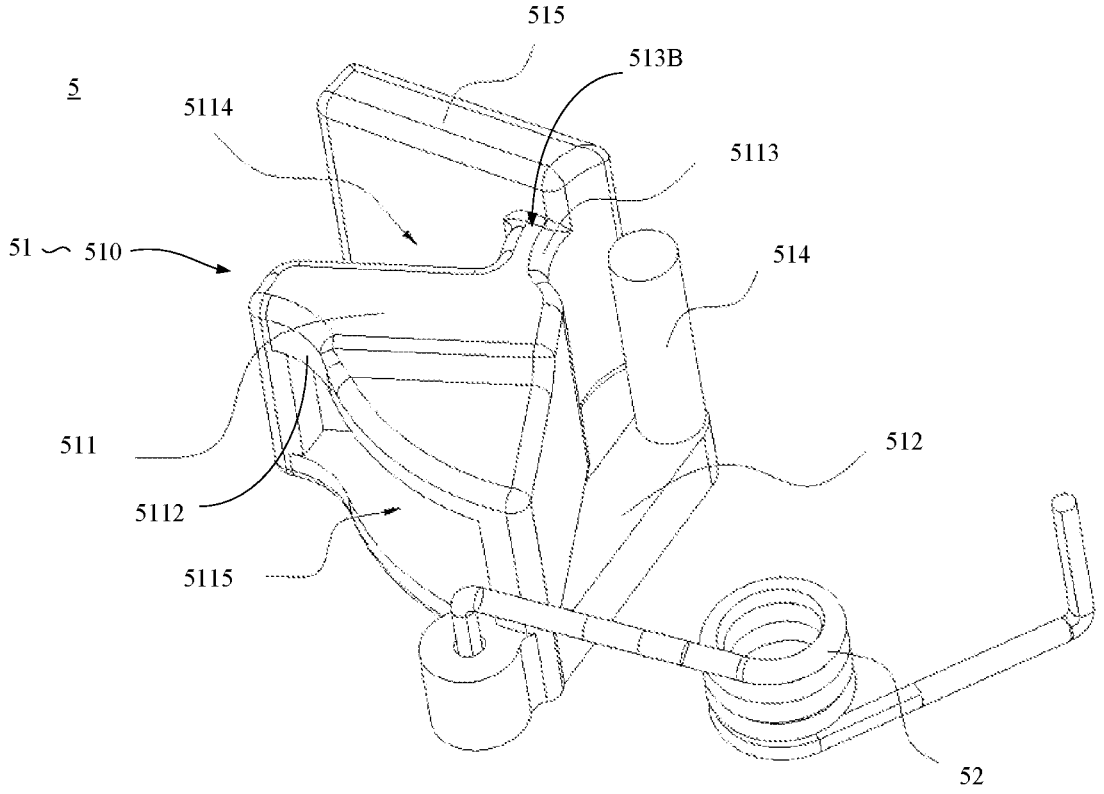
FIG. 9C is a diagram showing a structure after

As shown in FIGS. 9A to 9C, the limiting block 5 includes a limiting member 51 and a reset member 52.

In some embodiments, the limiting member 51 is rotatably connected with the guide seat 4, so that the limiting member 51 is pressed by the guide block 32 to pivot (e.g., the limiting member 51 is made to pivot toward a rear side of the guide groove 41) and exit the guide groove 41. For example, as shown in FIGS. 9A to 9C, the limiting member 51 includes a limiting member body 510 and a rotating shaft 514 connected with the limiting member body 510. The rotating shaft 514 is rotatably connected with the guide seat body 40, and the rotating shaft 514 is disposed proximate to a side of the guide seat body 40 proximate to the door body 20 (e.g., a front side), so that the limiting member 51 can be pressed by the guide block 32 to pivot toward the rear side of the guide groove 41 and exit the guide groove 41 to release a limitation on the guide block 32.

Figure 12A:
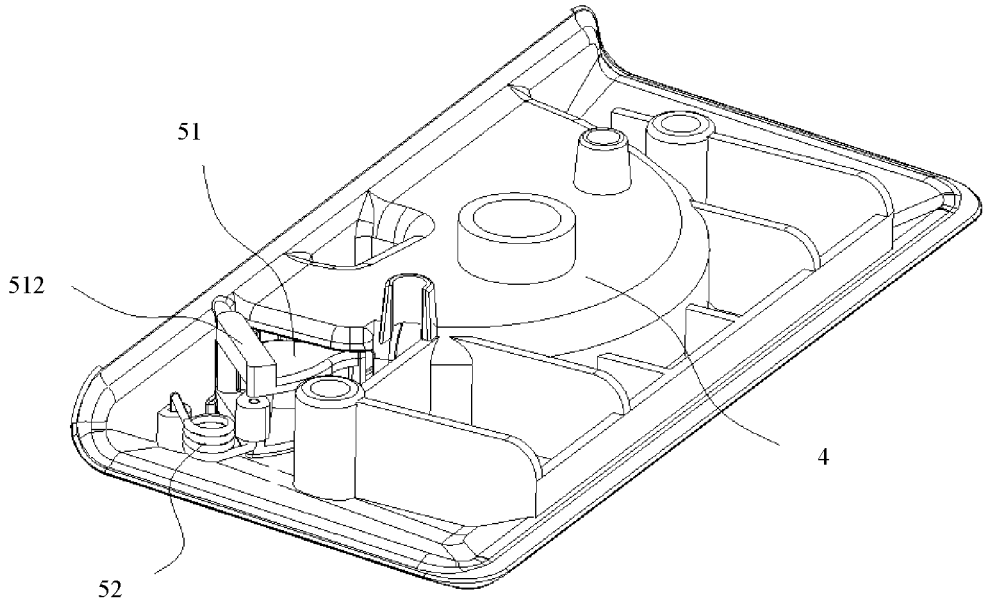
FIG. 12A is a diagram showing structures of a guide seat and a limiting block of a refrigerator, in accordance with some embodiments.
Figure 12B:
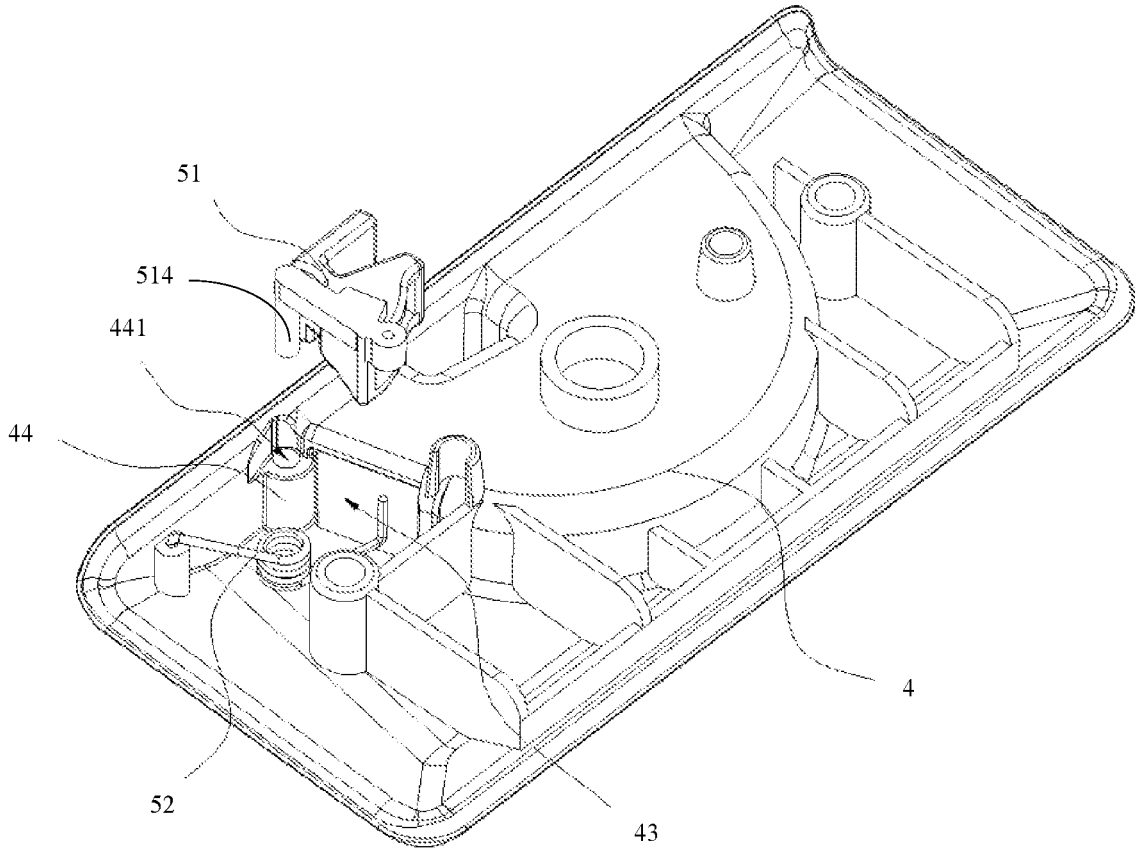
FIG. 12B is an exploded view of a guide seat and a limiting block of another refrigerator, in accordance with some embodiments.

In some embodiments, as shown in FIGS. 10C and 11C, the rotating shaft 514 is rotatably disposed on the guide seat 4 and is located at a junction of the opening 43 and the second inlet 413. As shown in FIG. 12B, the guide seat 4 further includes a hollow shaft column 44, and the shaft column 44 is located at the junction of the opening 43 and the second inlet 413. The shaft column 44 extends in a vertical direction, a shaft hole 441 is disposed in the shaft column 44, and the shaft hole 441 extends in the vertical direction. The rotating shaft 514 is disposed in the shaft hole 441, so that the rotating shaft 514 can pivot in the shaft hole 441.

For example, the rotating shaft 514 is detachably disposed in the shaft hole 441, which facilitates assembly and disassembly between the limiting block 5 and the guide seat 4.

As shown in FIGS. 10C and 11C, the reset member 52 is disposed on the guide seat 4, and the reset member 52 is connected with the limiting member 51, so as to drive the limiting member 51 to extend into the guide groove 41 through the opening 43. In addition, in a case where the guide block 32 completely enters the guide groove 41, the reset member 52 is reset, so that the limiting member 51 may be driven to extend into the guide groove 41 through the opening 43 and stop at the second inlet 413.

In some embodiments, as shown in FIGS. 9A to 9C, the reset member 52 is connected with an end portion of the limiting member 51 away from the rotating shaft 514, so that the reset member 52 can drive the limiting member 51 to pivot around the rotating shaft 514. As a result, the limiting member 51 extends into the guide groove 41 and substantially closes the second inlet 413.

In some embodiments, as shown in FIG. 10C, an outer wall of the shaft column 44 is formed with a first arc-shaped wall surface (referring to FIG. 12B), a position of the limiting member 51 that corresponds to the rotating shaft 514 is formed with a second arc-shaped wall surface, and the second arc-shaped wall surface matches with the first arc-shaped wall surface, so that the limiting member 51 pivots by resting on the outer wall of the shaft column 44, and seals a gap between the limiting member 51 and the shaft column 44 to prevent cold air from leaking from the gap.

In some embodiments, the reset member 52 adopts a torsion spring. An end of the torsion spring is hinged on the guide seat 4, and the other end of the torsion spring is hinged on the limiting member 51. For example, the other end of the torsion spring may be hinged at a position on the limiting member 51 away from the rotating shaft 514. A tension of the torsion spring can force the limiting member 51 to pass through the opening 43 to extend into the guide groove 41 (as shown in FIGS. 10A to 10C). In a case where the limiting member 51 is pressed to pivot and exit the guide groove 41, the torsion spring is compressed and deformed (as shown in FIGS. 11A to 12A). In a case where the guide block 32 completely enters the guide groove 41, the torsion spring can be reset to drive the limiting member 51 to extend into the guide groove 41 through the opening 43 and stop at the second inlet 413.

As shown in FIGS. 9A to 9C, the limiting member body 51 includes a tongue portion 511 and a limiting portion 512. The tongue portion 511 is located on a sidewall of the limiting portion 512 facing the opening 43. In a case where the reset member 52 is reset, the tongue portion 511 can pivot and pass through the opening 43 to extend into the guide groove 41.

As shown in FIGS. 9A and 9B, the limiting portion 512 protrudes upwards from a top surface of the tongue portion 511, so that a first step 513A is formed between the limiting portion 512 and the tongue portion 511. Thus, in a case where the tongue portion 511 extends into the guide groove 41 through the opening 43, the limiting portion 512 can abut against an edge of the opening 43 (as shown in FIGS. 10A to 10C), and the limiting portion 512 can stop the limiting member 51, thereby preventing the limiting member 51 from continuing to enter the guide groove 41.

Of course, in some embodiments, it may also be that the limiting portion 512 protrudes downwards from a bottom surface of the tongue portion 511, so that the first step 513A is formed between the limiting portion 512 and the tongue portion 511. In some embodiments, it may also be that the limiting portion 512 protrudes backwards from a side surface of the tongue portion 511 away from the door body 2, so that the first step 513A is formed between the limiting portion 512 and the tongue portion 511.

It will be understood that in a case where the turnover beam 3 is opened, the second portion 322 of the guide block 32 also has a tendency to exit the guide groove 41 from the second inlet 413, so that the second portion 322 presses the limiting member 51 from a side surface (e.g., a rear side surface) of the tongue portion 511 away from the door body 2. In this case, the limiting portion 512 can also prevent the tongue portion 511 from moving (e.g., pivoting) toward the front side of the guide groove 41, so that the limiting member 51 can stably stop at the second inlet 413, thereby preventing the guide block 32 from directly exiting the guide groove 41 from the second inlet 413.

In some embodiments, as shown in FIG. 9A, a side surface (e.g., a front side surface) of the tongue portion 511 proximate to the door body 20 is formed as an inclined surface 5111, and the inclined surface 5111 is configured to incline toward a rear side of the second inlet 413 in a direction away from the opening 43. For example, in a case where the opening 43 is located at a position on the guide wall 411 proximate to the second inlet 413, the inclined surface 5111 is configured to incline toward the rear side of the guide groove 41 in a direction from the second inlet 413 to the first inlet 412. In a case where the second portion 322 of the guide block 32 presses the tongue portion 511 through the second inlet 413, the second portion 322 can press the inclined surface 5111, so that the tongue portion 511 pivots to exit the guide groove 41, thereby releasing the limitation on the guide block 32. The guide seat 4 in FIG. 10A includes the limiting block 5 in FIG. 9A.

In some embodiments, as shown in FIGS. 9A to 9C, a smooth curved surface 5112 is formed on the rear side surface of the tongue portion 511. In a case where the tongue portion 511 is located in the guide groove 41, the smooth curved surface 5112 smoothly meets the rear side surface of the partition block 42 to jointly limit the guide block 32, so that the guide block 32 can be away from the smooth curved surface 5112 and the rear side surface of the partition block 42 and move toward the first inlet 412, and exit the guide groove 41 from the first inlet 412.

In the refrigerator 10 according to some embodiments of the present disclosure, the storage compartment 11 is sealed by using a cooperation between the door bodies 2 and the turnover beam 3, and the movement of the turnover beam 3 is guided by using a cooperation between the guide groove 41 of the guide seat 4 and the guide block 32 of the turnover beam 3. The limiting block 5 is rotatably connected with the guide seat 4, and pivots and extends into the guide groove 41 to limit the guide block 32, so that the normal opening or closing of the turnover beam 3 is stable. Moreover, in a case where the turnover beam 3 is abnormally closed, the first portion 321 of the guide block 32 enters the guide groove 41 from the first inlet 412, and the second portion 322 of the guide block 32 can press the limiting block 5 and force the limiting block 5 to pivot and exit the guide groove 41, so that the guide block 32 smoothly enters the guide groove 41, and finally, the limiting block 5 can be reset by pivoting, and re-extend into the guide groove 41 to limit the guide block 32, thereby achieving a purpose of closing the door body 2 normally when the turnover beam 3 is at a wrong position due to a misoperation of the user, and improving convenience of closing the door body 2.

In some embodiments, as shown in FIGS. 9B and 9C, the limiting block 5 is further configured to close the second inlet 413 to improve a sealing at the second inlet 413 and prevent cold air from leaking from the second inlet 413, so that condensation of the turnover beam 3 due to an excessively low temperature can be prevented, thereby facilitating improvement of a problem of the condensation of the turnover beam 3. Moreover, in a case where the turnover beam 3 is normally closed, the limiting block 5 may be kept flush with a side surface (e.g., a front surface) of the partition block 42 proximate to the door body 2 (referring to FIG. 10C). For example, a front side surface of the limiting block 5 is substantially coplanar with a front side surface of the guide seat 4, which improves aesthetics of an appearance of the refrigerator 10 (e.g., the refrigerator body 1).

In some embodiments, as shown in FIGS. 9B and 9C, the limiting member body 510 further includes a baffle portion 515. The baffle portion 515 is in a shape of a plate, and is configured to close the second inlet 413. A side surface (e.g., a front side surface) of the baffle portion 515 proximate to the door body 2 is formed as a flat surface. Thus, in a case where the baffle portion 515 extends into the guide groove 41 and closes the second inlet 413, the front side surface of the baffle portion 515 is flush with the front side surface of the second inlet 413. For example, the front side surface of the baffle portion 515 is substantially coplanar with the front side surface of the guide seat 4 (referring to FIG. 10C).

In some embodiments, the tongue portion 511 is disposed on a back side of the baffle portion 515 at an interval, so as to prevent the guide block 32 from exiting the guide groove 41 from the second inlet 413.

In some embodiments, the rear side surface of the tongue portion 511 is formed as a smooth curved surface 5112. In a case where the baffle portion 515 extends into the guide groove 41 and closes the second inlet 413, the rear side surface of the tongue portion 511 smoothly meets the rear side surface of the partition block 42.

In some embodiments, as shown in FIGS. 10B and 10C, in a case where the reset member 52 drives the limiting member 51 to close the second inlet 413, the limiting portion 512 can abut against an inner edge of a top of the opening 43 (as shown in FIG. 10B), so that the limiting portion 512 can stop the limiting member body 510 and prevent the limiting member body 510 from continuing to enter the guide groove 41. In this case, the front side surface of the baffle portion 515 is substantially coplanar with the front side surface of the second inlet 413 (as shown in FIG. 10C).

In some embodiments, the limiting member 51 is formed as an integral structural member. For example, as shown in FIG. 9A, the tongue portion 511, the rotating shaft 514, and the limiting portion 512 may be formed as an integral structural member.

In some embodiments, as shown in FIGS. 98 and 9C, the limiting member 51 further includes a connecting portion 5113. The connecting portion 5113 is connected with the baffle portion 515 and the tongue portion 511, and the connecting portion 5113 is configured to pivot by resting on the outer wall of the shaft column 44.

For example, the connecting portion 5113 has an arc-shaped structure and is located on a peripheral side of the shaft column 44. A side (e.g., a front side) of the connecting portion 5113 proximate to the door body 2 is connected with the baffle portion 515, and a side (e.g., a rear side) of the connecting portion 5113 away from the door body 2 is connected with the tongue portion 511. Thus, the baffle portion 515, the tongue portion 511, and the connecting portion 5113 may all pivot by resting on the periphery of the shaft column 44.

In some embodiments, the baffle portion 515, the tongue portion 511, and the connecting portion 5113 may be formed as an integral structural member.

As shown in FIGS. 98 and 9C, the limiting member 51 further includes a weight reducing notch 5114 and a weight reducing groove 5115. However, the present disclosure is not limited thereto, and the limiting member 51 may include at least one of the weight reducing notch 5114 or the weight reducing groove 5115.

In some embodiments, as shown in FIG. 9B, the weight reducing notch 5114 is formed among the baffle portion 515, the connecting portion 5113, and the tongue portion 511, so as to reduce a weight of the limiting member 51.

In some embodiments, as shown in FIG. 9C, the weight reducing groove 5115 is further disposed in the tongue portion 511, and the weight reducing groove 5115 can reduce the weight of the limiting member 51. The limiting member 51 in FIG. 9C includes the weight reducing notch 5114 and the weight reducing groove 5115, so that the weight of the limiting member 51 can be further reduced.

In some embodiments, as shown in FIG. 9C, a bottom surface of the baffle portion 515 protrudes downwards from the bottom surface of the tongue portion 511, so that a second step 513B is formed between the bottom surface of the baffle portion 515 and the bottom surface of the tongue portion 511. In a case where the limiting member 51 is pressed by the guide block 32 to pivot and exit the guide groove 41, a lower end of the baffle portion 515 can abut against an outer edge of a lower end of the opening 43, so that the baffle portion 515 stops at the opening 43.

Of course, in some embodiments, it may also be that the baffle portion 515 protrudes upwards from the top surface of the tongue portion 511, so that the second step 513B is formed between the top surface of the baffle portion 515 and the top surface of the tongue portion 511.

In the refrigerator 10 according to some embodiments of the present disclosure, the storage compartment 11 is sealed by using the cooperation between the door bodies 2 and the turnover beam 3, and the movement of the turnover beam 3 is guided by using the cooperation between the guide groove 41 of the guide seat 4 and the guide block 32 of the turnover beam 3. The front side opening of the guide groove 41 is partitioned into the first inlet 412 and the second inlet 413 spaced in the left-and-right direction by the partition block 42, and the limiting block 5 is rotatably connected with the guide seat 4.

In a case where the turnover beam 3 is abnormally closed, the avoidance groove 33 can be opposite to the partition block 42 to avoid the partition block 42, and the guide block 32 can enter the guide groove 41 from the first inlet 412 and the second inlet 413 simultaneously. For example, the first portion 321 of the guide block 32 enters the guide groove 41 through the first inlet 412, and the second portion 322 of the guide block 32 presses the limiting block 5 at the second inlet 413 to force the limiting block 5 to pivot and exit the second inlet 413 and finally enter the guide groove 41, thereby achieving the purpose of a normal closing of the door bodies 2 when the turnover beam 3 is at the wrong position due to the user's misoperation.

In addition, after the guide block 32 completely enters the guide groove 41, the limiting block 5 can be reset by pivoting, and re-extends into the guide groove 41 to close the second inlet 413, which improves the sealing at the second inlet 413, prevents cold air from leaking from the second inlet 413, and improves the aesthetics of the appearance of the refrigerator 10 (e.g., the refrigerator body 1).

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

It will be appreciated by those skilled in the art that the scope of disclosure involved in the present disclosure is not limited to technical solutions formed by particular combinations of the above technical features, but shall also encompass other technical solutions formed by any combination of the above technical features or equivalents thereof without departing from the concept of present disclosure, for example, the technical solutions formed by replacing the above features with technical features having similar functions disclosed in some embodiments (but not limited thereto).

What is claimed is:

1. A refrigerator, comprising:

a refrigerator body including a storage compartment;

a pair of door bodies pivotally connected with the refrigerator body to open or close the storage compartment;

a turnover beam, the turnover beam being pivotally connected with one of the pair of door bodies to seal a gap between the pair of door bodies when closing the storage compartment, and the turnover beam including a turnover beam body and a guide block located on a top of the turnover beam body;

a guide seat located on a top of the storage compartment, the guide seat including a guide seat body and a guide groove disposed in the guide seat body, and the guide groove being open at a bottom thereof and including a front side opening, so that the guide groove is engaged with the guide block; and a limiting block rotatably connected with the guide seat body, wherein, when at least a portion of the guide block presses the limiting block through the front side opening of the guide groove, the limiting block is configured to pivot and exit the guide groove, and after the guide block enters the guide groove, the limiting block is configured to be reset by pivoting to limit the guide block, wherein the guide block includes a first portion, a second portion and an avoidance groove located between the first portion and the second portion;

the front side opening includes a first inlet and a second inlet; and the limiting block being disposed proximate to the second inlet; and the guide seat further includes:

a partition block configured to partition the front side opening into the first inlet and the second inlet, and an opening, the limiting block rotatably passing through the opening and extending into the guide groove through the opening to stop at the second inlet, wherein the first inlet is configured to allow the guide block to enter the guide groove in a case where the turnover beam is normally closed, to allow the guide block to exit the guide groove in a case where the turnover beam is normally opened, and to allow the first portion of the guide block to enter the guide groove in a case where the turnover beam is abnormally closed;

the second inlet is configured to allow the second portion of the guide block to enter the guide groove in a case where the turnover beam is abnormally closed; and the avoidance groove is configured to avoid the partition block in a case where the turnover beam is abnormally closed, so that the first portion enters the guide groove from the first inlet, and the second portion enters the guide groove from the second inlet by pressing the limiting block, wherein the limiting block includes:

a limiting member rotatably connected with the guide seat body, wherein the limiting member includes a limiting member body and a rotating shaft, the rotating shaft is connected with the limiting member body, and the rotating shaft is rotatably connected with the guide seat body and located at a junction of the opening and the second inlet; and a reset member, the reset member being connected with the guide seat body and the limiting member, so as to drive the limiting member to extend into the guide groove through the opening and stop at the second inlet, wherein the reset member drives the limiting member to pivot around the rotating shaft, so that the limiting member body extends into the guide groove and substantially closes the second inlet, wherein the limiting member body includes a tongue portion and a limiting portion, the tongue portion is located at a position on the limiting portion facing the opening, and the tongue portion extends into the guide groove to stop at the second inlet.

2. The refrigerator according to claim 1, wherein the opening satisfies one of the following:

the opening is located on a sidewall of the guide groove proximate to the second inlet;

the opening is located at a position on a top wall of the guide seat body and proximate to the second inlet; or the opening is located on a sidewall of the partition block proximate to the second inlet, and the limiting block is rotatably disposed in the partition block.

3. The refrigerator according to claim 1, wherein the reset member includes a torsion spring, an end of the torsion spring is hinged to the guide seat body, and another end of the torsion spring is hinged to the limiting member.

4. The refrigerator according to claim 1, wherein the guide seat further includes a hollow shaft column, the shaft column is connected with the guide seat body, and the shaft column is configured to match with the rotating shaft; and the rotating shaft is disposed by passing through the shaft column and is detachably connected with the shaft column.

5. The refrigerator according to claim 1, wherein a side surface of the tongue portion proximate to the door body is provided as an inclined surface, and the inclined surface is configured to incline toward a side of the guide groove away from the door body in a direction away from the opening.

6. The refrigerator according to claim 1, wherein a side surface of the tongue portion away from the door body is provided as a smooth curved surface, and the smooth curved surface is configured to be cooperated with a side surface of the partition block away from the door body to jointly guide and limit the guide block.

7. The refrigerator according to claim 1, wherein the limiting portion is configured to stop the tongue portion in a case where the tongue portion extends into the guide groove through the opening; and the limiting portion satisfies at least one of the following:

the limiting portion protrudes upwards from a top surface of the tongue portion;

the limiting portion protrudes downwards from a bottom surface of the tongue portion; or the limiting portion protrudes backwards from a side surface of the tongue portion away from the door body.

8. The refrigerator according to claim 1, wherein the limiting member body further includes a baffle portion, and the baffle portion is connected with the tongue portion and is configured to substantially close a side of the second inlet proximate to the door body.

9. The refrigerator according to claim 8, wherein in a case where the baffle portion closes the second inlet, the limiting portion abuts against an edge of a side of the opening away from the guide groove, and a side surface of the baffle portion proximate to the door body is substantially coplanar with a side surface of the guide seat body proximate to the door body.

10. The refrigerator according to claim 8, wherein the tongue portion is disposed on a side of the baffle portion away from the door body at an interval, so as to prevent the guide block from exiting the guide groove from the second inlet.

11. The refrigerator according to claim 10, wherein a side surface of the tongue portion away from the door body is provided as a smooth curved surface, and in a case where the baffle portion closes the second inlet, a side surface of the baffle portion proximate to the door body is substantially coplanar with a side surface of the guide seat body proximate to the door body, and the side surface of the tongue portion away from the door body smoothly meets the side surface of the partition block away from the door body.

12. The refrigerator according to claim 8, wherein in a case where the guide block presses the limiting member to pivot to exit the guide groove, the baffle portion abuts against an edge of a side of the opening proximate to the guide groove.

13. The refrigerator according to claim 8, wherein the limiting member body further includes a connecting portion, an end of the connecting portion proximate to the door body is connected with the baffle portion, and an end of the connecting portion away from the door body is connected with the tongue portion;

the guide seat further includes a hollow shaft column, and the connecting portion is configured to rotate by resting on an outer wall of the shaft column; and the baffle portion, the connecting portion, and the tongue portion are provided as an integral structural member.

14. The refrigerator according to claim 13, wherein the limiting member further includes at least one of a weight reducing notch or a weight reducing groove, wherein the weight reducing notch is disposed among the baffle portion, the connecting portion, and the tongue portion; and the weight reducing groove is disposed in the tongue portion.

* * * * *